US008671721B2

(12) United States Patent
Yu et al.

(10) Patent No.: US 8,671,721 B2
(45) **Date of Patent: *Mar. 18, 2014**

(54) LOCK STRUCTURE

(75) Inventors: Chang-Chiang Yu, Chung-Ho (TW); Chun-Sheng Wu, Chung-Ho (TW)

(73) Assignee: Sinox Company Ltd., Chung-Ho (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/402,683

(22) Filed: Feb. 22, 2012

(65) Prior Publication Data

US 2012/0312056 A1 Dec. 13, 2012

Related U.S. Application Data

(63) Continuation-in-part of application No. 13/115,816, filed on May 25, 2011.

(60) Provisional application No. 61/420,658, filed on Dec. 7, 2010, provisional application No. 61/361,775, filed on Jul. 6, 2010.

(51) Int. Cl.

| | |
|---|---|
| ***E05B 73/00*** | (2006.01) |
| ***E05B 9/10*** | (2006.01) |
| ***E05B 17/04*** | (2006.01) |
| ***E05B 69/00*** | (2006.01) |
| ***E05B 13/02*** | (2006.01) |

(52) U.S. Cl.

USPC ..... 70/14; 70/379 R; 70/379 A; 70/58; 70/424; 70/428

(58) Field of Classification Search

USPC ..... 70/379 R, 379 A, 14, 18, 49, 57, 58, 423, 70/424, 427–430, 492

See application file for complete search history.

(56) References Cited

U.S. PATENT DOCUMENTS

| | | | |
|---|---|---|---|
| 5,327,752 | A | 7/1994 | Myers et al. |
| 5,381,685 | A | 1/1995 | Carl et al. |
| 6,006,557 | A | 12/1999 | Carl et al. |

(Continued)

FOREIGN PATENT DOCUMENTS

| | | |
|---|---|---|
| TW | 431516 | 4/2001 |
| TW | 435561 | 5/2001 |
| TW | 582423 | 4/2004 |

OTHER PUBLICATIONS

Official Action for U.S. Appl. No. 13/115,816, mailed Nov. 20, 2012 16 pages.

(Continued)

*Primary Examiner* — Christopher Boswell
*Assistant Examiner* — Eric Kurilla
(74) *Attorney, Agent, or Firm* — Sheridan Ross P.C.

(57) ABSTRACT

A lock structure for an electrical device is provided. The lock structure includes a rotatable fastener, a lock body, an operation device, and a housing. The lock body is disposed at least partially in the housing, connected with the operation device, and couples with a driving portion. When the lock body is in an unlocked state, the lock body allows the driving portion to move the rotatable fastener. Simultaneously, the operation device can move the driving portion to change the orientation of the rotatable fastener, resulting in the connection/detachment of the lock structure and the electronic device. When the lock body is in a locked state, movement of the driving portion is restricted and the operation device cannot directly or indirectly rotate the rotatable fastener, resulting in the secure connection of the lock structure and the electronic device.

15 Claims, 33 Drawing Sheets

(56) References Cited

U.S. PATENT DOCUMENTS

| | | | |
|---|---|---|---|
| 6,058,744 | A | 5/2000 | Ling |
| 6,212,918 | B1 | 4/2001 | Kravtin |
| 6,513,350 | B1 | 2/2003 | Hurd et al. |
| 6,553,794 | B1 | 4/2003 | Murray, Jr. et al. |
| 6,588,241 | B1 | 7/2003 | Murray, Jr. et al. |
| 6,619,080 | B1 | 9/2003 | Yu |
| 6,619,081 | B1 | 9/2003 | Yu |
| 6,735,990 | B1 | 5/2004 | Murray, Jr. et al. |
| 6,918,272 | B1 | 7/2005 | Sanders |
| 6,973,809 | B2 | 12/2005 | Chang |
| 7,100,403 | B2 | 9/2006 | Murray, Jr. et al. |
| 7,121,125 | B2 | 10/2006 | Murray et al. |
| 7,140,210 | B2 | 11/2006 | Cheng |
| 7,370,499 | B1 | 5/2008 | Lee |
| 7,401,481 | B1 | 7/2008 | Lin |
| 7,614,266 | B2 | 11/2009 | White et al. |
| 8,230,707 | B2 | 7/2012 | Hung et al. |
| 2003/0101778 | A1 | 6/2003 | Carl et al. |
| 2006/0288745 | A1 | 12/2006 | Murray et al. |
| 2009/0049876 | A1 | 2/2009 | White et al. |
| 2012/0006080 | A1 | 1/2012 | Yu et al. |

OTHER PUBLICATIONS

Official Action for U.S. Appl. No. 13/115,816, mailed Apr. 23, 2013, 14 pages.

Official Action for U.S. Appl. No. 13/115,816, mailed Apr. 28, 2013, 9 pages.

LOCK STRUCTURE

CROSS REFERENCE TO RELATED APPLICATIONS

The present application is a continuation-in-part of U.S. application Ser. No. 13/115,816 entitled "Lock Structure" filed May 25, 2011, and claims the benefit of U.S. Provisional Application Ser. Nos. 61/361,775 filed Jul. 6, 2010, and 61/420,658 filed Dec. 7, 2010, the entirety of each is incorporated herein by this reference.

BACKGROUND OF THE INVENTION

1. Field of the Invention

The present invention generally relates to lock structures, particularly, to a burglar proof lock for electronic devices.

2. Description of the Prior Art

Consumer electronic products have played an important role in modern life. Moreover, because of fast modern lifestyle and the demand for instant information, portable electronic devices have become essential in the lives of most people. Unfortunately, because of the popularity of and demand for such devices, the relatively high cost, the relatively small and/or portable size, and the adaptability of such devices to most anyone's needs, the possibility of these electronic devices being stolen is high.

To deter or prevent theft, a lock structure has been developed for use with electronic devices. The structure generally comprises an opening or lock hole incorporated into the electronic device, such as a notebook computer, and a separate fastener that interconnect with the lock hole and is further controlled by a lock mechanism to accomplish the locking/unlocking operation. The lock hole is typically surrounded by or incorporates a reinforced structure. However, operation of these lock structures can be awkward or inconvenient. For example, when connecting a lock to the lock hole by inserting the lock fastener into the lock hole and performing the locking operation, it is often required to simultaneously but individually operate the rotatable fastener and the lock body, or to insert a key into a key hole to operate the lock fastener that is controlled by a lock mechanism. Therefore, there is room for improvement in the design, structure and operation of locks for electronic devices.

SUMMARY OF THE INVENTION

It is an object of the present invention to provide a lock structure for preventing valuable products, such as electronic devices, from being stolen through an improved rotatable fastener of the lock structure.

It is another object of the present invention to provide a lock structure which is simple and easy to use and can be quickly connected to and/or disconnected from a guarded object, such as an electronic device.

Embodiments of the present invention provide a lock structure capable of connecting to the lock hole of an electronic device. In one or more of these embodiments, the lock structure has a housing, a lock body, an operation device, and a rotatable fastener. A protruding or extending portion, typically formed by two columnar structures spaced apart from each other, is formed on the housing. A through hole communicating with the inside of the housing is disposed between the two columnar structures. The rotatable fastener is positioned between the two columnar structures and has an extension portion penetrating the through hole into the housing. A retaining portion is further formed at an end of the rotatable fastener and together with the extension portion form a generally T-shaped structure. The lock structure interconnects with the lock hole of the electronic device through the T-shaped structure and the protrusion or extending portion.

Embodiments of the present invention incorporate a combination lock into the lock body. In some of these embodiments, the lock body of a combination lock may include a shaft movable in axial direction and a plurality of wheels coupling with the shaft. When the wheels are positioned corresponding to the correct password or authorization code to be in an unlocked state, the lock body allows the shaft to move axially. In an unlocked state, displacement of an operation device enables a guiding face thereof to move the shaft axially and simultaneously rotate the rotatable fastener.

Therefore, when the user turns the wheels corresponding to the correct password to place the lock in an unlocked state, the shaft of the lock body is unconstrained and allowed to move axially. In addition, moving the operation device causes the rotatable fastener including the extension and retaining portions to rotate and the T-shaped structure moves from an orientation disassociated from the two columnar structures to an orientation aligned with the two columnar structures. Stated differently, the T-shaped structure moves to a position parallel to a virtual line connecting the two columnar structures, and the connecting part (namely, the protruding portion, the extension portion, and the retaining portion) of the lock structure can be inserted into the lock hole of an electronic device. Alternatively, if the connecting part of the lock structure is already inserted in the lock hole, the connecting part of the lock structure is allowed to be withdrawn and separated from the lock hole. When the operation device is released, the operation device will return to its original position and, simultaneously, the rotatable fastener rotates back to its original position. In its original position, the orientation of the retaining portion of the rotatable fastener is disassociated from the protrusion portion. In other words, the T-shaped structure is perpendicular to the virtual line connecting the two columnar structures. As a result, if the connecting part is mated with a lock hole, the connecting part may not be withdrawn from the lock hole and the lock structure may not be detached from the electronic device. By altering the position of one or more wheels of the lock body, the electronic device is securely locked to the lock body.

Embodiments of the present invention may incorporate a key lock into the lock body. In some of these embodiments, the lock body of a key lock includes a restriction unit and is movable in axial direction. In response to the axial displacement of the restriction unit controlled by the key, the lock body is in an unlocked state or a locked state. When the lock body is in the locked state, the restriction unit of the lock body is at a second position where the restriction unit blocks an operation device from moving so that the operation device cannot cause the rotatable fastener to rotate. When the lock body is in an unlocked state, the restriction unit is at a first position where it will no longer block the operation device from moving. In this state, movement of the operation device causes the driving portion of the operation device to drive the rotatable fastener to rotate.

Therefore, when the lock body is in the unlocked state, moving the operation device causes the rotatable fastener, including the extension and retaining portions of the rotatable fastener, to rotate and the T-shaped structure moves from an orientation disassociated from the two columnar structures to an orientation aligned with the two columnar structures. Stated differently, the T-shaped structure moves to a position parallel to a virtual line connecting the two columnar structures, and the connecting part (namely, the protruding portion, the extension portion, and the retaining portion) of the lock structure can be inserted into or separated from the lock hole of the electronic device. When released, the operation device will return to its original position and, simultaneously, the rotatable fastener rotates back to its original position. In its original position, the orientation of the retaining portion of the rotatable fastener is disassociated from the protrusion portion. In other words, the T-shaped structure is perpendicular to the virtual line connecting the two columnar structures. As a result, if the connecting part is mated with the lock hole, the connecting part may not be withdrawn from the lock hole and the lock structure may not be detached from the electronic device. By pressing the lock body, the electronic device is securely locked to the lock body. In some embodiments of the present invention, the lock body of a key lock also serves as the operation device. The lock body/operation device includes or is provided with a driving portion, and is movable in axial direction in response to pressing or moving the lock body/operation device in the unlocked state to achieve the locking operation or performing the unlocking operation by a key. The axial movement of the lock body/operation device enables the driving portion thereof to cause the rotatable fastener to rotate, namely when the lock body/operation device is axially moved to achieve the locking operation, the orientation of the retaining portion of the rotatable fastener is aligned with the protrusion portion, i.e., it is parallel virtual line connecting the two columnar structures so that the connecting part can be inserted into the lock hole. On the other hand, when performing the unlocking operation, the orientation of the retaining portion of the rotatable fastener is disassociated from the protrusion portion, i.e., perpendicular to the virtual line connecting the two columnar structures, so that if the connecting part is mated with the lock hole, it may not b e withdrawn from the lock hole.

Figure 1:
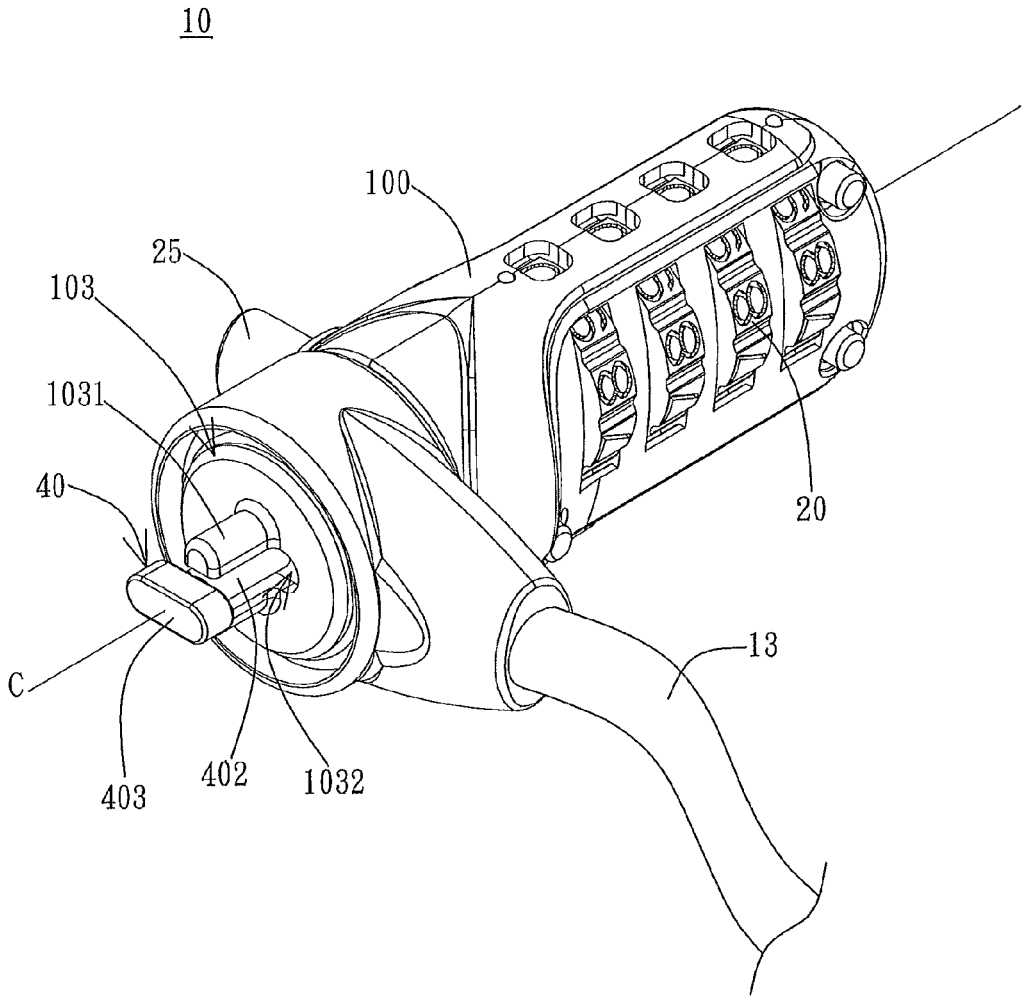
FIG. 1 is a perspective view of one embodiment of the present invention.

It should be understood that the drawings are not necessarily to scale. In certain instances, details that are not necessary for an understanding of the invention or that render other details difficult to perceive may have been omitted from these drawings. It should be understood, of course, that the invention is not limited to the particular embodiments illustrated in the drawings.

DETAILED DESCRIPTION

The present invention provides a lock structure for electronic devices. Electronic devices include, but are not limited to, portable devices such as laptop or notebook computers. As FIG. 1 shows, a lock structure 10 includes a housing 100, a lock body 20, an operation device 25, and a rotatable fastener 40. The housing 100 encloses at least one chamber or interior for at least partially accommodating the lock body 20, the operation device 25, and the rotatable fastener 40. A flexible cable 13 can be connected to the housing 100 for securing the lock structure and the interconnected electronic device to a stationary object, such as a table, or a fixed or immovable object. A protruding portion 1031 is disposed on an end of the housing 100. The protruding portion 1031 includes two columnar structures spaced apart from each other. The two columnar structures can be, for example, two columns or posts having a semi-circular cross-section configured to restrict one-dimensional lateral movement. A through hole 1032 communicating with the interior of the housing 100 is disposed between the two columnar structures of the protruding portion 1031. The rotatable fastener 40 includes an extension portion 402 penetrating the through hole 1032 between the two columnar structures of the protruding portion 1031. The rotatable fastener 40 further includes a retaining portion 403 formed at an end of the extension portion 402. The retaining portion 403 together with the extension portion 402 forms a T-shaped structure. The T-shaped structure and the protruding portion 1031 can be selectively engaged with the lock hole of the electronic device to secure the electronic device to another object for security purposes. Structures and related connections of the housing 100, the lock body 20, the operation device 25, and the rotatable fastener 40 are described below.

Figure 2:
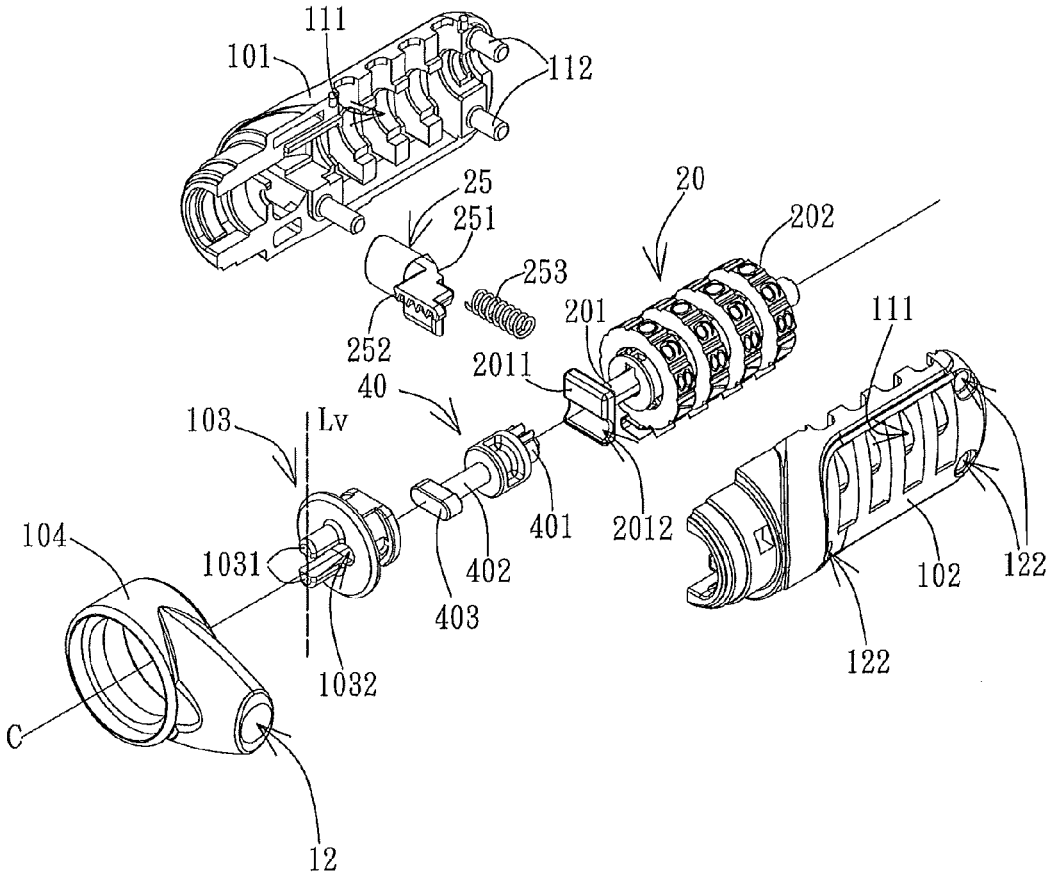
FIG. 2 is an exploded view of the embodiment of FIG. 1.

FIG. 2 shows an exploded view of the embodiment of the lock structure of FIG. 1. The housing 100 is composed of several housing parts. For example, as shown, the housing 100 includes a first housing part 101 and a second housing part 102 connected to each other to form the chamber or interior for accommodating other components of the lock structure. In this embodiment, the first housing part 101 has a plurality of coupling posts 112, and the second housing part 102 has a plurality of holes 122 corresponding to the plurality of coupling posts 112 of the first housing part 101. The holes 122 and corresponding coupling posts 112 are aligned so that the first housing part 101 and the second housing part 102 are combined to form the housing 100 for accommodating the lock body 20. As is known in the art, the distal ends of the posts 112 are deformed to couple or join the housing parts together.

In the present embodiment, the lock body 20 can be a combination lock having a plurality of wheels 202. In such a case, the first housing part 101 and the second housing part 102 can individually have a plurality of exposing holes or windows 111 corresponding to the wheels 202. The wheels 202 extend through the exposing holes 111 to permit a user to manipulate the relative positions of the wheels 202. In other words, the user can rotate the wheels 202 by engaging the portions of the wheels exposed through the exposing hole 111 to position the wheels in the correct orientation or sequence to achieve the locking/unlocking operation. Moreover, a joint unit 103 is disposed at one end of the housing 100 and is connected to the first housing part 101 and the second housing part 102 in this embodiment. The protruding portion 1031 is disposed at one side of the joint unit 103. A housing ring 104 comprises another component of the housing 100. The housing ring 104 connects to one end of the first and second housing parts 101, 102 and encloses the joint unit 103. As illustrated, the housing ring 104 has a prominent part 12 for securing the flexible cable 13. It is noted that the connection between the prominent part 12 of the housing ring 104 and the flexible cable 13, and between the housing ring 104 and the housing 100, can be achieved by any proper manner as known to those of skill in the art, such as engaging, adhering, screwing, fastening, etc.

Moreover, as FIG. 2 shows, in this embodiment, the lock body 20 includes a shaft 201 and the plurality of wheels 202 coupling with the shaft 201. The shaft 201 is selectively movable in axial direction C. When the user rotates the wheels corresponding to the password or authorization code, the lock body 20 is in an unlocked state and the shaft 201 of the lock body 20 may move axially. In contrast, when the positions of the wheels do not correspond to the password or authorization code and the lock body 20 is in a locked state, the shaft 201 cannot move axially. The operation of the lock mechanism comprising the shaft 201 and the wheels 202 of the lock body 20 is similar to a conventional combination lock and is well known to those of ordinary skill in the art. The connection and mechanism of the shaft 201 together with the other components of the lock structure 10 will be described in detail hereinafter.

Figure 3A:
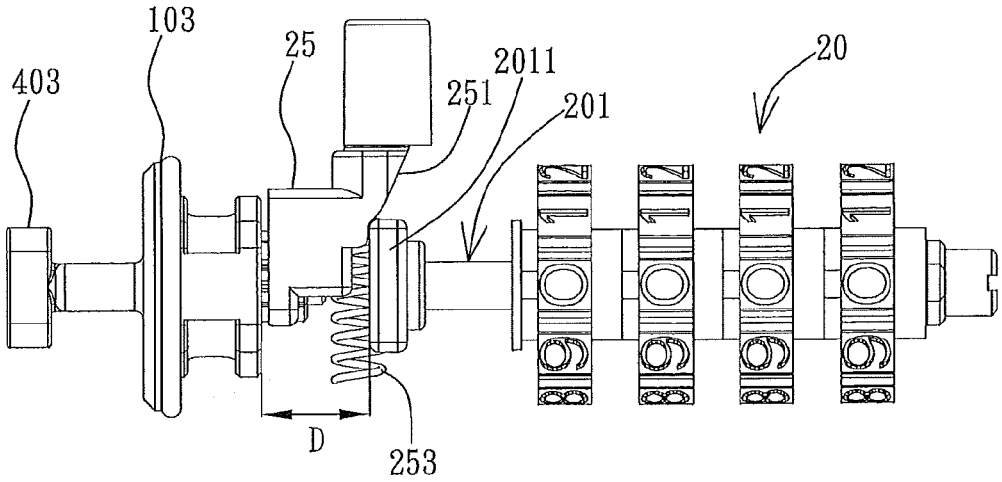
FIGS. 3A-3F are plan and perspective views of components of the embodiment of FIG. 1.
Figure 3B:
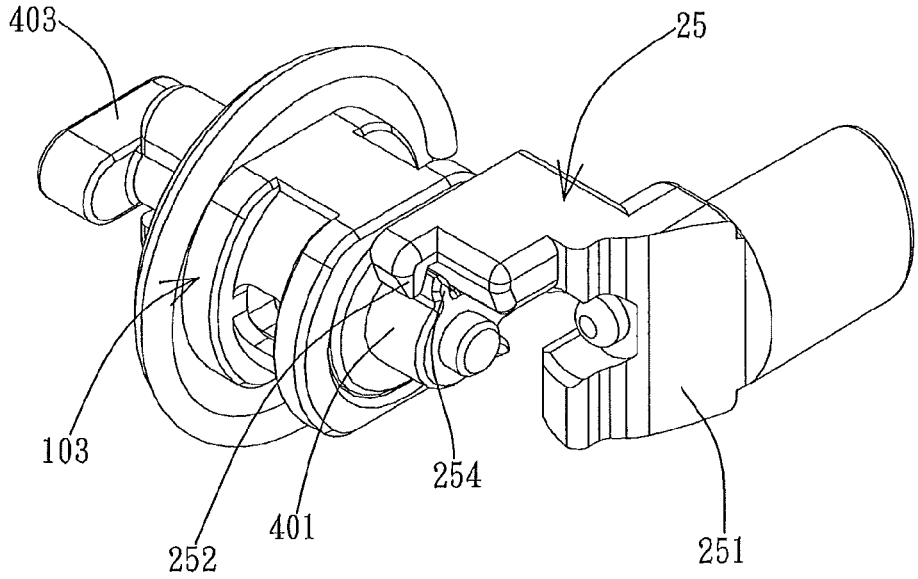

As FIG. 2 also shows, a baffle plate 2011 is disposed at an end of the shaft 201, and an accommodating groove 2012 is formed on the baffle plate 2011 for receiving an elastic element 253 therein. The baffle plate 2011 operatively couples with the operation device 25 with the shaft 201 such that the shaft 201 can be driven in response to the operation of the operation device 25. As FIG. 2 and FIGS. 3A-3B show, the operation device 25 has a guiding face 251 and a driving portion 252, wherein the guiding face 251 is in contact with an end of the baffle plate 2011. The guiding face 251 may be an inclined face, as shown in FIG. 3A. The operation device 25 further contains an elastic or biasing element 253. The elastic element 253 is preferably a spring or other element having elasticity. The elastic element 253 is disposed between the operation device 25 and the shaft 201 and is positioned in the accommodating groove 2012 of the baffle plate 2011. The elastic element 253 selectively provides elastic force in response to the operation of the operation device 25.

As FIG. 2 and FIGS. 3A-3B show, the rotatable fastener 40 is disposed at one side of the operation device 25 opposite to the baffle plate 2011. The rotatable fastener 40 includes a base portion 401, an extension portion 402 and the retaining portion 403. In one embodiment of the present invention, as FIG. 3A shows, the joint unit 103 surrounds the rotatable fastener 40, with the extension portion 402 passing through the through hole 1032 of the joint unit 103 and parallel to the protruding portion 1031 of the joint unit 103, and the retaining portion 403 extends beyond the distal end of the columnar protruding portion 1031. When the rotatable fastener 40 rotates, the orientation of the retaining portion 403, which is perpendicularly connected to the extension portion 402, is correspondingly changed in a manner that the retaining portion 403 may be selectively oriented parallel or perpendicular to a virtual line $L_v$ connecting the two columnar structures, so that the lock structure 10 is selectively detachable from or engaged with a lock hole associated with the electronic device. (Compare, the perpendicular orientation of FIGS. 3A and 3B with the parallel orientation of FIGS. 4A and 4B.)

Figure 3C:
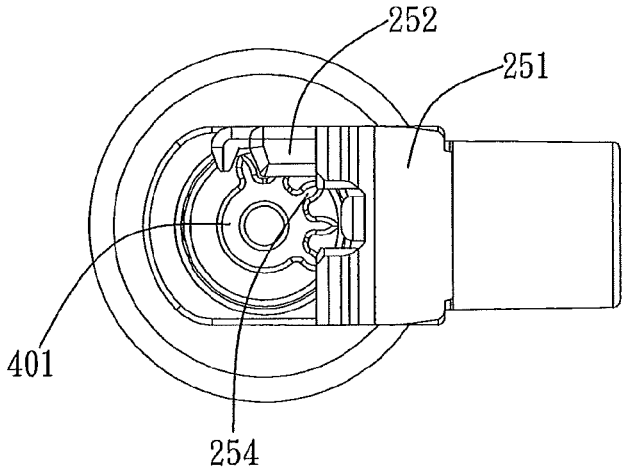
Figure 3D:
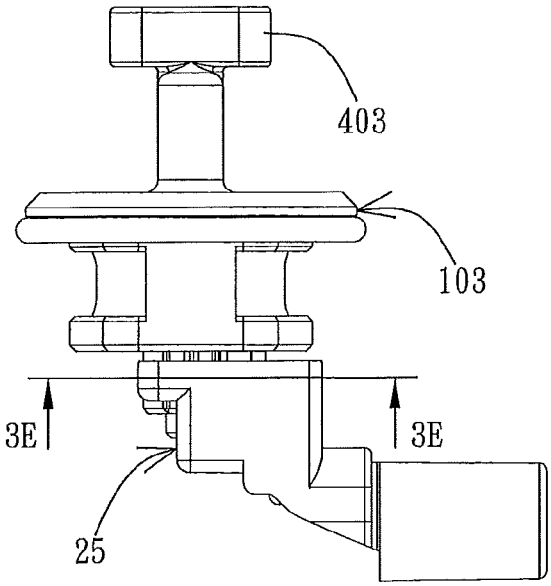
Figure 3E:
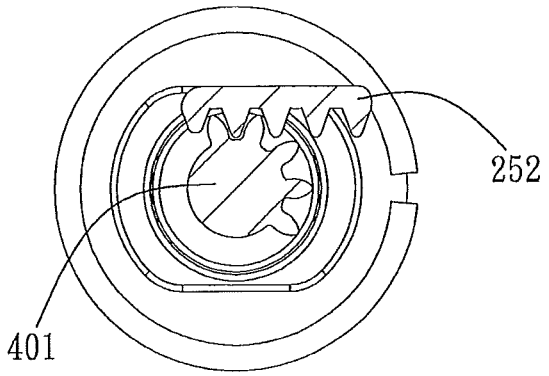

As shown in FIG. 3A, there is a distance D between the joint unit 103 and the baffle plate 2011. The base portion 401 of the rotatable fastener 40 is disposed in the space defined by the distance D which is inside the chamber of the housing 100. As FIGS. 3A-3B show, the base portion 401 of the rotatable fastener 40 couples with the driving portion 252 of the operation device 25. Due to this coupling, the rotatable fastener 40 rotates in response to the operation of the operation device 25 to switch the orientation of the retaining portion 403 with regard to the protruding portion 1031 of the joint unit 103. For example, in a preferred embodiment of the present invention, the base portion 401 comprises a gear wheel, and the structure of the driving portion 252 is formed as a gear rack corresponding to the gear wheel 254 of the base portion 401. As FIGS. 3C-3E show, the teeth of the gear rack-like driving portion 252 are complementary to and couple with the teeth of gear wheel 254 of the base portion 401. It should be appreciated that the gear wheel need only provide a sufficient number of teeth to interface with the teeth of the gear rack to cause sufficient rotation of the rotatable fastener to accomplish the task of the rotatable fastener as described herein.

Figure 3F:
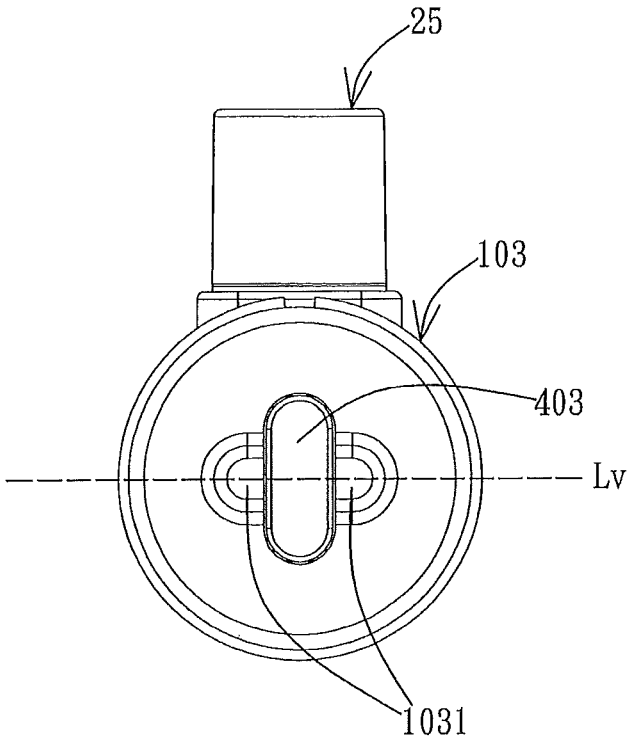

From the views shown in FIGS. 3A and 3F, it can be seen that the retaining portion 403 of the rotatable fastener 40 is oriented perpendicular to the protruding portion 1031 (i.e., the orientation of the retaining portion 403 is perpendicular to the virtual line $L_v$ connecting the two columnar structures). As shown in FIGS. 3A, 3B, 3D and 3F, the retaining portion 403 extends beyond a projection area of the protruding portion 1031, defined by the distal ends of the columnar structures or posts. This enables the retaining portion 403 to engage with the lock hole of the electronic device. That is, when the connecting part (namely, the protruding portion 1031, the extension portion 402 and the retaining portion 403) of the lock structure 10 is inserted into a lock hole, by operating the operation device 25 the driving portion 252 can drive the base portion 401 of the rotatable fastener 40 so that the retaining portion 403 rotates from a position generally aligned with the protruding portion (e.g., FIGS. 4A, 4B) approximately ninety (90) degrees (e.g., FIGS. 3A, 3B) to secure the lock structure 10 to the electronic device such that the lock structure 10 cannot be freely detached from the lock hole in the locked state so as to secure the electronic device against theft.

Figure 4A:
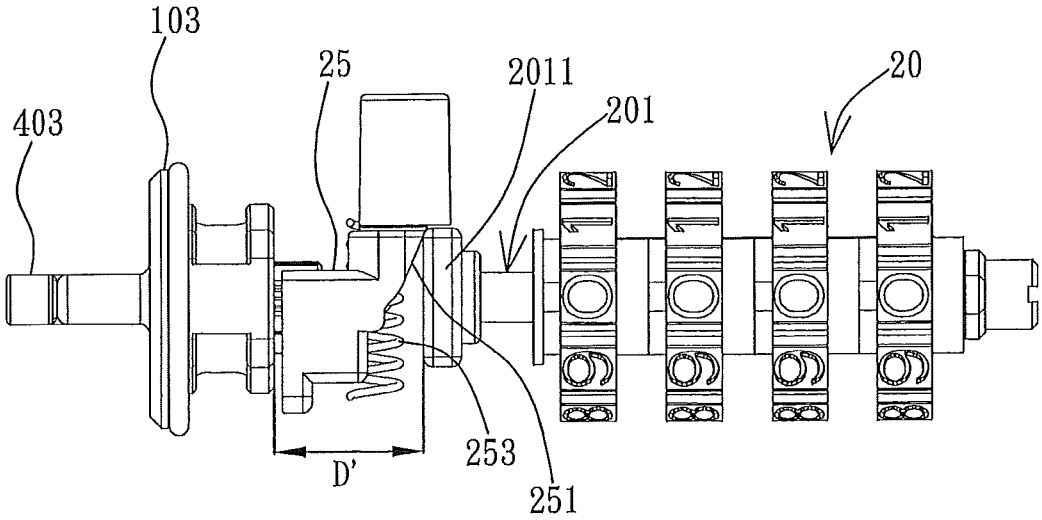
FIGS. 4A-4F are plan and perspective views of components of the embodiment of FIG. 1.
Figure 4B:
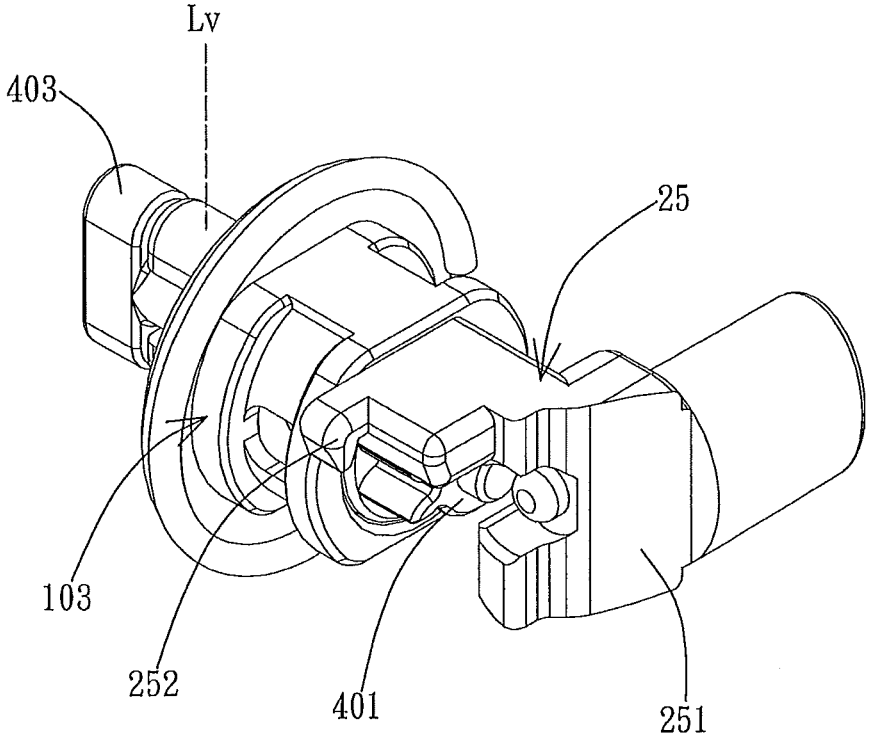
Figure 4C:
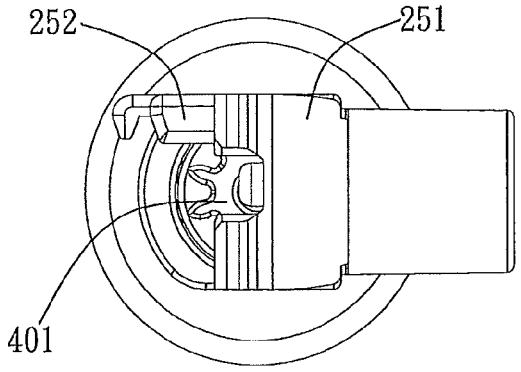
Figure 4D:
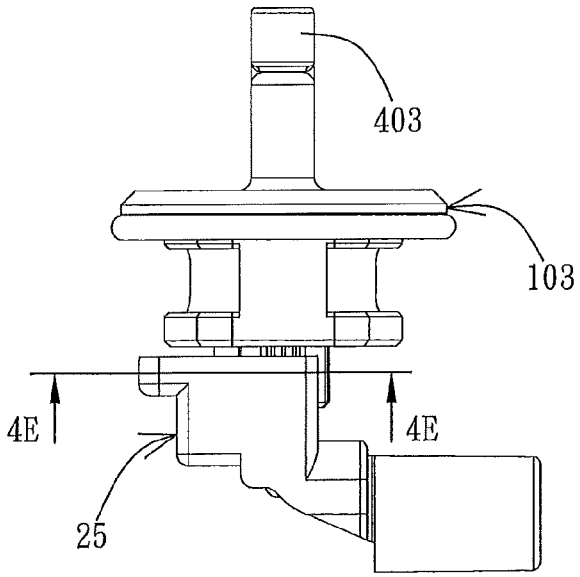
Figure 4E:
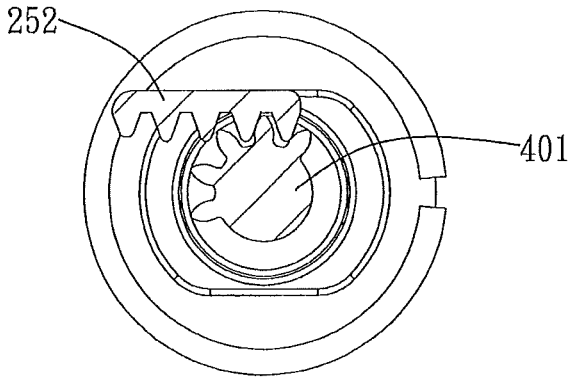
Figure 4F:
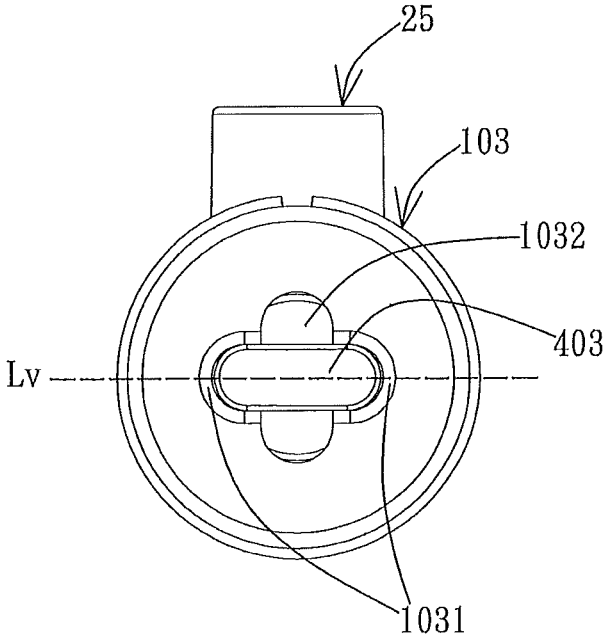

When the lock body 20 is in an unlocked state, the shaft 201 of the lock body 20 is allowed to move axially. As FIG. 4A shows, because the shaft 201 can move axially, the user can depress the operation device 25, which is in a first or extended position at this point, so that the guiding face 251 moves toward the shaft 201 to push the shaft 201 to move axially along the guiding face (i.e., the inclined face). Due to the pressing operation device 25, the elastic element 253 is compressed, and the distance D between the joint unit 103 and the baffle plate 2011 is increased to a larger distance D'. In other words, in the unlocked state, the movement of the operation device 25 is not restricted. Therefore, when the operation device 25 is pressed, simultaneously, the driving portion 252 of the operation device 25 drives the base portion 401 of the rotatable fastener 40 so that the rotatable fastener 40 rotates. In the illustrated embodiment, the rotation angle is ninety (90) degrees. As FIGS. 4B-4E show, the pressed operation device 25 will drive the gear rack-like driving portion 252 to push the gear 254 of the base portion 401 to rotate. As can be seen from FIGS. 4A and 4F, pressing the operation device 25 successively makes the retaining portion 403 of the rotatable fastener 40 rotate to an orientation parallel to the protruding portion 1031 (i.e., the orientation of the retaining portion 403 is parallel to the virtual line $L_v$ connecting the two columnar structures). In this orientation, the retaining portion 403 is within the projection area of the protruding portion 1031 and the connecting part (the protruding portion 1031, the extension portion 402 and the retaining portion 403) is able to be inserted into or detached from the lock hole of the electronic device. That is, when the connecting part of the lock structure 10 is positioned in the lock hole and the lock body 20 is in a locked state with the retaining portion 403 oriented perpendicular to the protruding portion 1031, by unlocking the lock body 20 and operating the operation device 25 (e.g. pressing), the retaining portion 403 of the rotatable fastener 40 is driven to rotate so that the retaining portion reorients to a parallel position relative to the protruding portion 1031 and lock structure 10 may be detached from the lock hole.

Releasing the operation device 25 will simultaneously release the compression of the elastic element 253. The elastic force provided by the elastic element 253 will cause the operation device 25 to return to its original extended position and the rotatable fastener 40 correspondingly rotates to revert to its original position as shown in FIG. 3F. That is, when the lock body 20 is in the unlocked state, by pressing the operation device 25, the retaining portion 403 orients itself relative to the protruding portion 1031 such that the lock structure 10 may be inserted into or withdrawn from the lock hole. By releasing the pressing action on the operation device 25, the retaining portion 403 will rotate ninety (90) degrees and, together with the protruding portion 1031, will secure the lock structure 10 to the electronic device if the connecting part is positioned inside the lock hole associated with the electronic device. Afterwards, rotating the wheels of the lock body 20 will accomplish locking the lock body 20 such that the lock structure 10 cannot be separated from the electronic device. In this way, the operation procedures are simplified compared to the current state of the art.

Figure 5A:
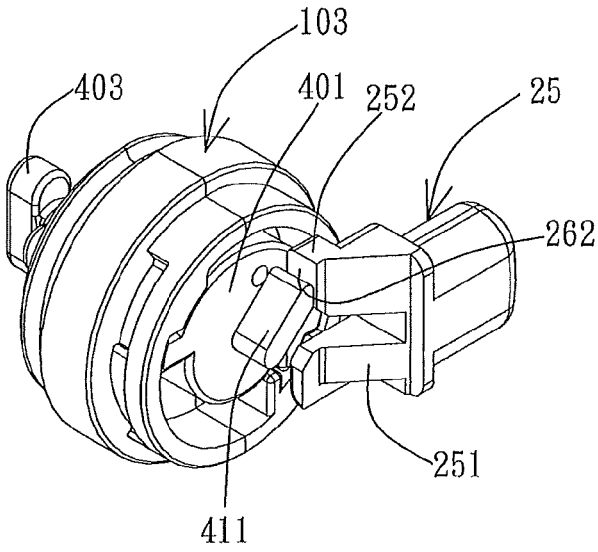
FIGS. 5A-5C are plan and perspective views of components of another embodiment of the present invention.
Figure 5B:
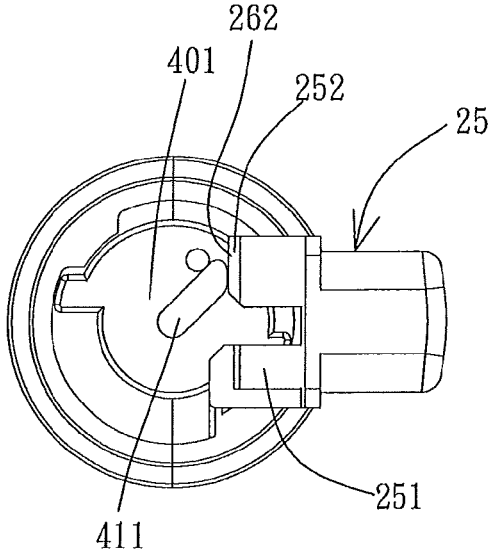
Figure 5C:
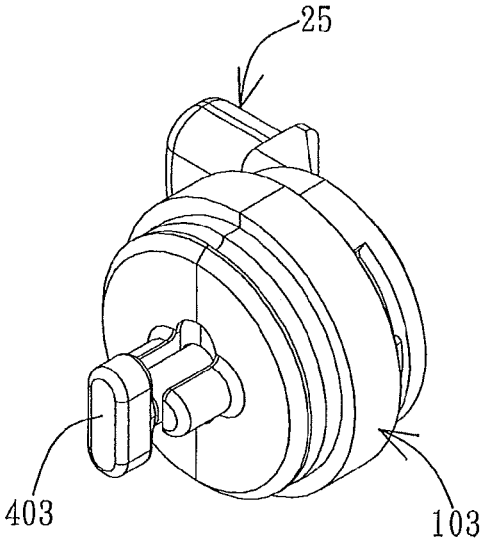

In other embodiments, the driving portion 252 of the operation device 25 and the base portion 401 of the rotatable fastener 40 are not limited to the above addressed gear rack and gear wheel assembly. Any mechanism capable of allowing the operation device 25 to drive the rotatable fastener 40 to rotate may be used in the present invention. For example, as FIGS. 5A-5C show, the end of the driving portion 252 can be a flat planer surface 262 for coupling with an extension or arm disposed on the base portion 401 of the rotatable fastener 40. As illustrated, the base portion 401 of the rotatable fastener 40 may further comprise an arm 411 radially oriented on the base portion 401 which is driven by the flat planer surface 262 of the driving portion 252. When the lock body is in the unlocked state, the displacement of the operation device 25 will cause the planer surface 262 of the driving portion 252 to push a radially outer portion of the arm 411 of the base portion 401 to drive the rotatable fastener 40 to rotate, switching the position of the retaining portion 403.

Figure 6A:
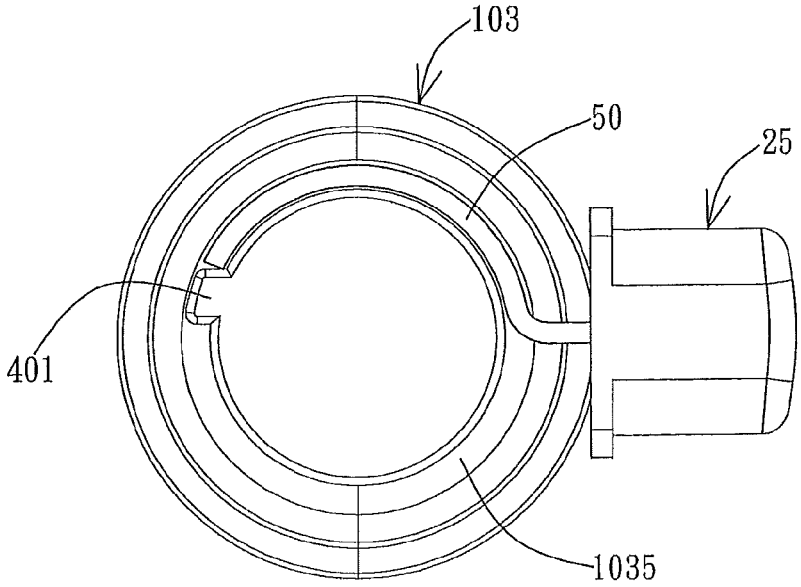
FIGS. 6A-6D are plan views of components of another embodiment of the present invention.
Figure 6B:
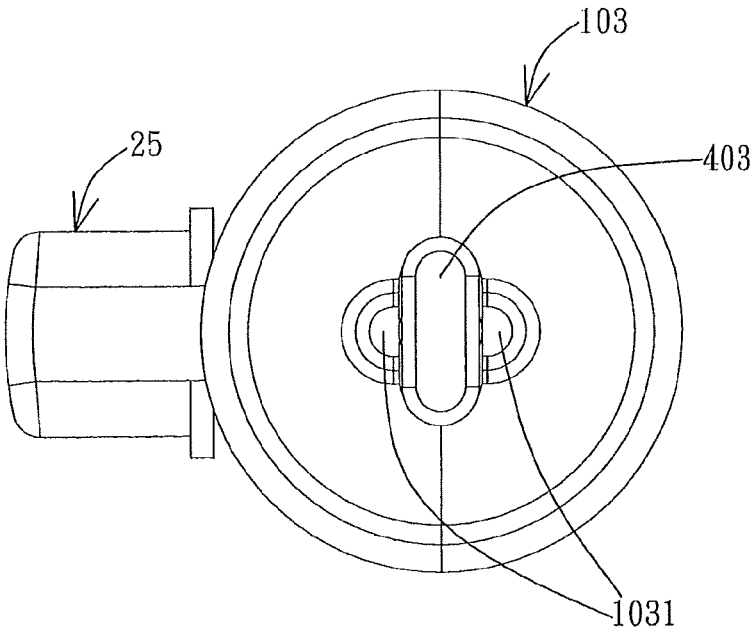
Figure 6C:
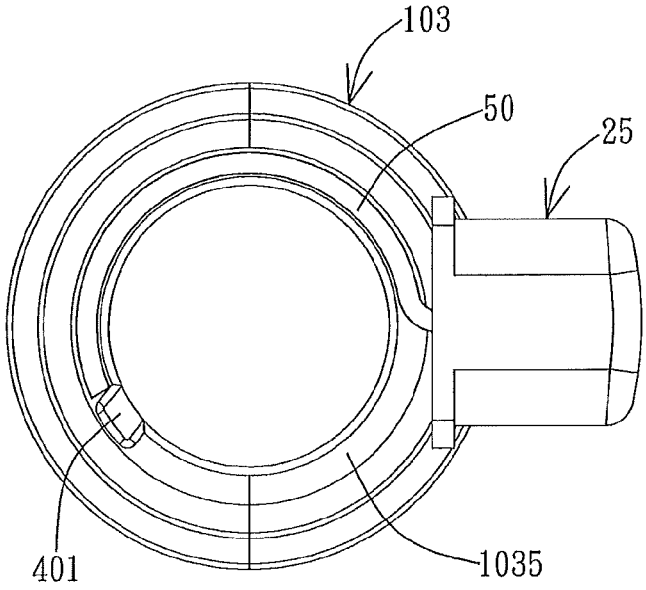
Figure 6D:
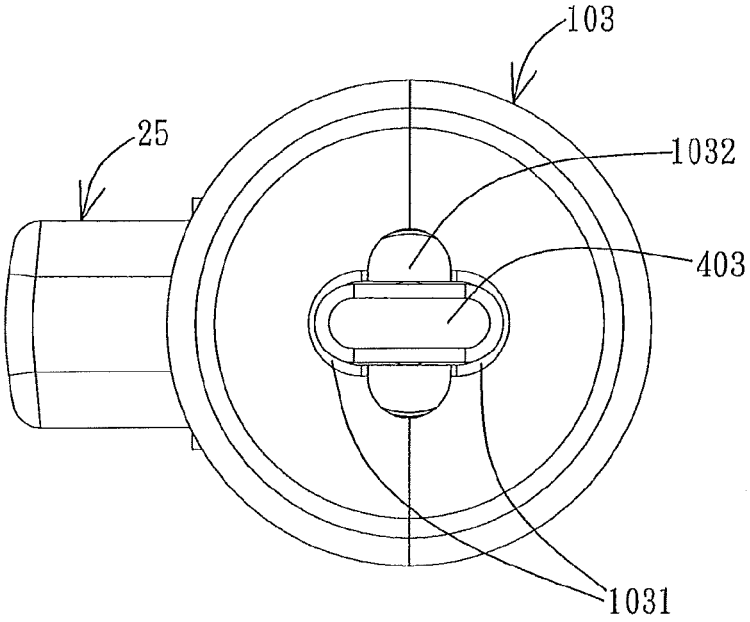

Another embodiment is shown in FIGS. 6A-6D. In this embodiment, the operation device 25 couples with a dense spring 50. The dense spring 50 is disposed in a channel 1035 formed on a side of the joint unit 103 facing the chamber. The end of the dense spring 50 couples with the base portion 401. FIG. 6A shows the relative positions of the operation device 25, the dense spring 50 and the base portion 401 when the operation device 25 is not pressed. In this state, as shown in FIG. 6B, the retaining portion 403 of the rotatable fastener 40 is perpendicular to the protruding portion 1031. As shown in FIG. 6C, displacement of the operation device 25 made by pressing the operation device 25 will push the dense spring 50 through the channel 1035 causing the end of the dense spring 50 to push the base portion 401. Movement of the base portion 401 causes the rotatable fastener 40 to rotate. After rotating, as shown in FIG. 6D, the retaining portion 403 is parallel to the protruding portion 1031 so that the protruding portion 1031 and the retaining portion 403 can be inserted into the lock hole or removed from the lock hole.

Figure 7A:
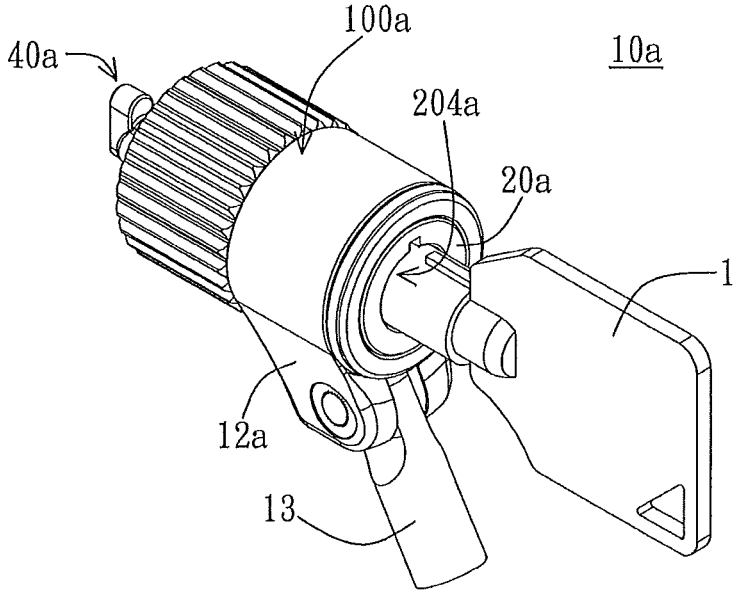
FIGS. 7A-7B are perspective views of another embodiment of the present invention.
Figure 7B:
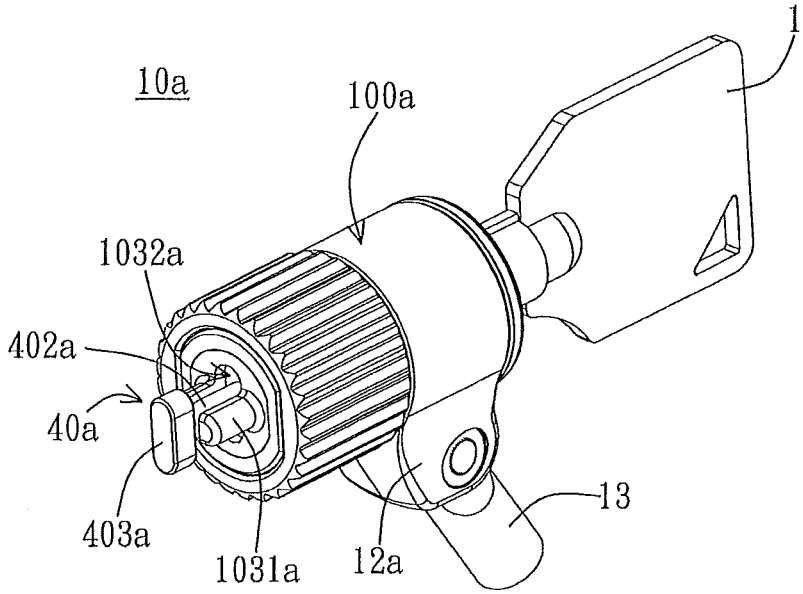

Another embodiment is shown in FIGS. 7A-7B. This embodiment utilizes a key activated lock structure 10*a* which includes a housing 100*a*, a lock body 20*a* (see FIG. 8), and a rotatable fastener 40*a*. The housing 100*a* defines a chamber which at least partially encloses the lock body 20*a* and the rotatable fastener 40*a*. A flexible cable 13 can be connected to the housing 100*a* for securing an electronic device to a stationary object, such as a table, or a fixed object. A joint unit 103*a* is disposed at one end of the housing 100*a*. A protruding portion 1031*a* is disposed on one side of the joint unit 103*a* and comprises a pair of columnar protruding posts positioned on opposite sides of a through hole 1031*a*. The two columnar structures can be, for example, two columns or posts having a semi-circular cross-section that are configured to restrict one-dimensional lateral movement of the lock structure 10*a*. It should be appreciated that the columnar structures may have different cross-sectional shapes besides semi-circular. The through hole 1032*a* communicates with the inside of the housing 100*a*. The rotatable fastener 40*a* includes an extension portion 402*a* penetrating the through hole 1032*a* between the two columnar structures of the protruding portion 1031*a*. The rotatable fasteners also include a base portion 401*a* which includes a shoulder portion 404*a* formed at one end of the extension portion 502*a* which has a diameter that is wider than the through hole 1032*a* and abuttingly engages an inside surface of the joint unit 103*a*. The rotatable fastener 40*a* further includes a retaining portion 403*a* formed at the opposite end of the extension portion 402*a*. The retaining portion 403*a* together with the extension portion 402*a* forms a T-shaped structure. The T-shaped structure and the protruding portion 1031*a* can be selectively engaged with the lock hole of the electronic device to secure the electronic device to the stationary or fixed object. Structures and related connections of the housing 100*a*, the lock body 20*a*, the operation device 25*a*, and the rotatable fastener 40*a* are described below.

Figure 8:
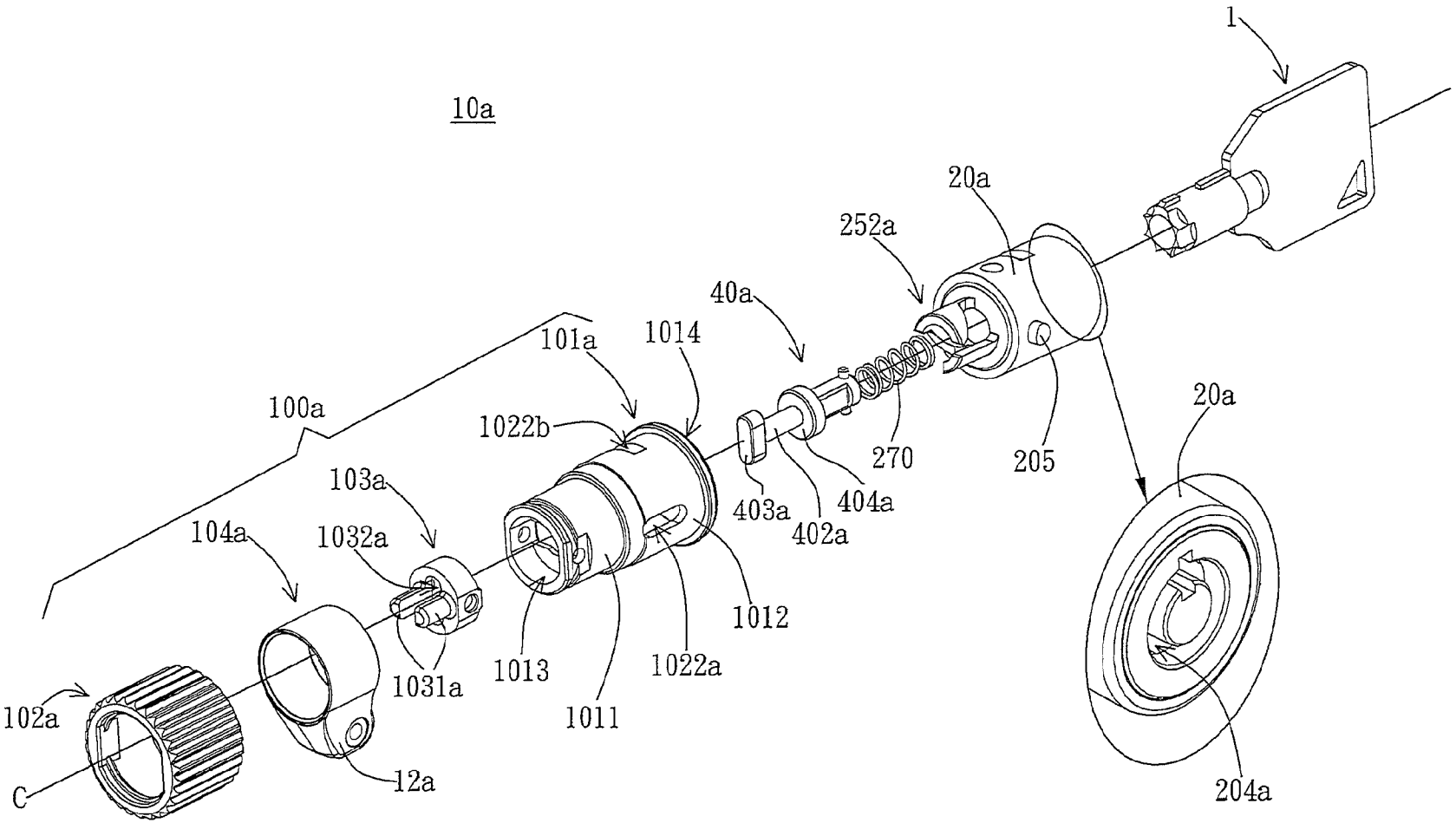
FIG. 8 is an exploded view of the embodiment of FIGS. 7A-7B.

FIG. 8 shows an exploded view of the embodiment of the lock structure 10*a* of FIGS. 7A and 7B. The housing 100*a* includes several housing parts. For example, as shown, the housing 100*a* includes an inner housing 101*a*, an outer housing 102*a*, the joint unit 103*a*, and a housing ring 104*a* connected to each other to form the chamber for accommodating other components of the lock structure. In this embodiment, the inner housing 101*a* has a first portion 1011 and a second portion 1012 connected to each other. The first portion 1011 and the second portion 1012 are tubular and the diameter of the second portion 1012 is larger than the diameter of the first portion 1011. The first portion 1011 and the second portion 1012 have openings 1013 and 1014, respectively, and define the chamber there between for accommodating other components. The second portion 1012 is formed with a plurality of slots 1022*a* and 1022*b*. The slots 1022*a* and 1022*b* are provided for positioning and/or aligning the components inside the inner housing 101*a* and/or restricting rotation of the components. For example, the slot 1022*a* has a length in the axial direction of the second portion 1012 to restrict the range of axial movement of the lock body 20*a*. The slot 1022*b* has a length extending along the circumference of the second portion 1012 and generally perpendicular to the axial direction of the second portion 1012 to restrict the range of rotation of the lock body 20*a*. The joint unit 103*a* is connected to the inner housing 101*a* at the opening 1013 of the first portion 1011. When the joint unit 103*a* is assembled with the inner housing 101*a*, the protruding portion 1031*a* protrudes outside the opening 1013. The housing 104*a* fits over the outer circumferential surface of the second portion 1012. The housing ring 104*a* further has a portion 12*a* for securing the flexible cable 13 (see FIG. 7A or 7B). The outer housing 102*a* fits over the outer circumferential surface of the first portion 1011 of the inner housing 101*a* and adjacent to the housing ring 104*a* so that the first portion 1011 of the inner housing 101*a* is covered by the outer housing 102*a*. In one embodiment, the outer housing 102*a* is made of rubber and has a rough outer surface such as a surface with a plurality of axial grooves to facilitate a user holding or grasping the lock structure 20*a*. It is noted that the connection between the portion 12*a* of the housing ring 104*a* and the flexible cable 13 and the connection among the inner housing 101*a*, the outer housing 102*a*, the joint unit 103*a*, and the housing ring 104*a* can be achieved by any proper manner, such as engaging, adhering, screwing, fastening, etc.

The lock body 20*a* disposed in the chamber of the housing 100*a* includes a key way or key hole 204 as shown in FIG. 7A to receive a specially configured key 1. In this embodiment, the lock body 20*a* is provided with a driving portion 252*a* which also functionally serves as an operation device like the operation device 25 of the embodiments shown in FIGS. 1-6D. When the user inserts and rotates an appropriately configured key 1 in the key way 204, the lock body 20*a* will be released from a secured state and free to move axially within the inner housing 101*a*. These types of key locks are known to those of skill in the art. In this released state, the driving portion 252*a* is also operable to move axially and, in doing so, causes the rotatable fastener 40*a* to rotate. When the lock body 20*a* and driving portion 252*a* are in the released state and have not been moved axially inwardly, the connecting part (namely the protruding portion 1031*a*, the extension portion 402*a*, and the retaining portion 403*a*) can be detached from or inserted into a lock hole. In this first or released state, the lock body 20*a* (i.e. the operation device) can be pressed axially inwardly. Furthermore, when the user moves the lock body 20*a* axially inwardly, the driving portion 252*a* will act correspondingly and drive the rotatable fastener 40*a* to rotate. When the rotational device 40*a* rotates, the retaining portion 403*a* also rotates. Upon rotation of the rotating portion 403*a*, the lock body 20*a* will be in a locked state, and further movement of the driving portion 252*a* and the rotatable fastener 40*a* will be restricted. In this second or locked state, if the connecting part is mated with a lock hole, the connecting part will be engaged with the lock hole. In addition, the lock body 20*a* cannot be moved axially and locking is achieved. A lock core (not shown) inside the lock body 20*a* and the key hole 204 cooperate with an appropriately configured key to secure or release the lock body 20*a*. The mechanism and operation with regard to the lock body 20*a* are similar to a conventional key lock and need not be elaborated as the structure and operation are known to those of skill in the art. The interaction and mechanism of the driving portion 252*a* together with the other components of the lock structure 10*a* will be described in detail hereinafter.

Figure 9A:
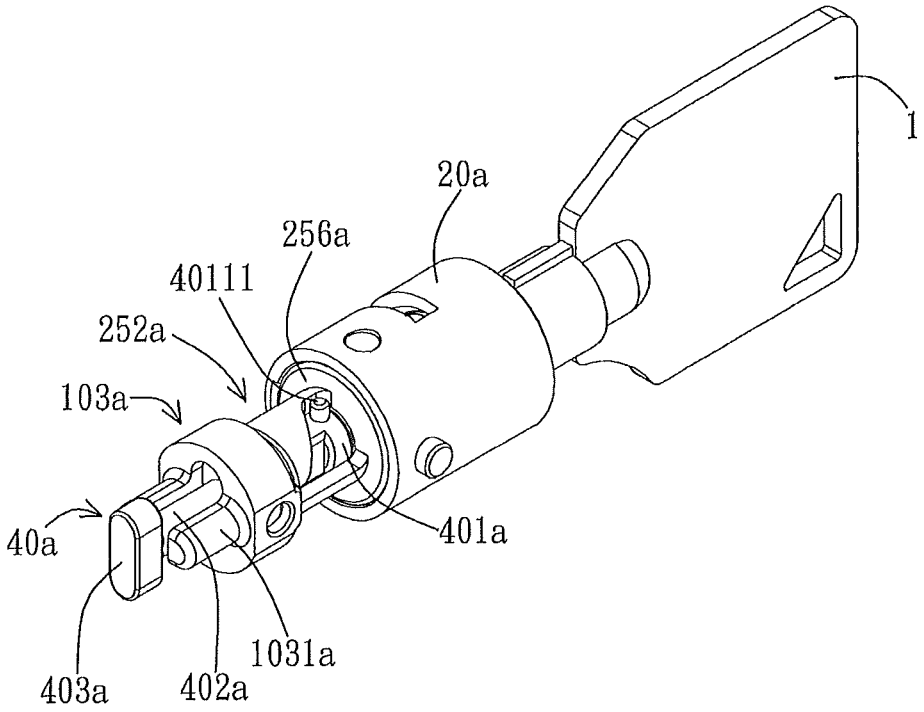
FIGS. 9A-9B are perspective views of components of the embodiment of FIGS. 7A-7B.
Figure 9B:
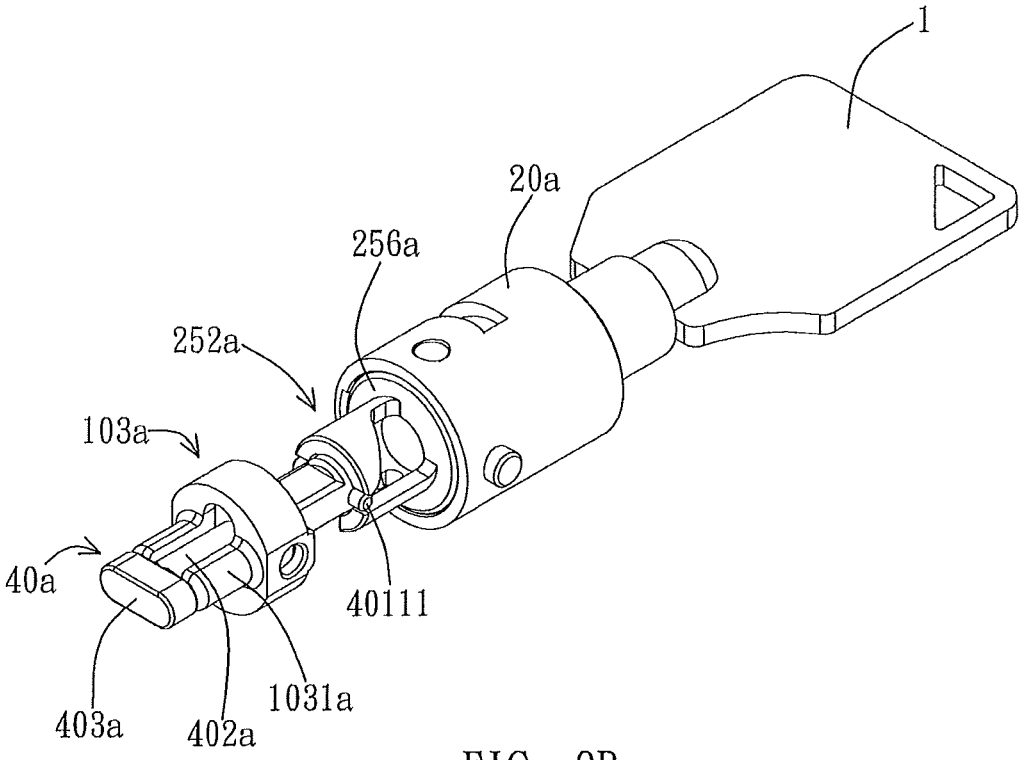
Figure 10A:
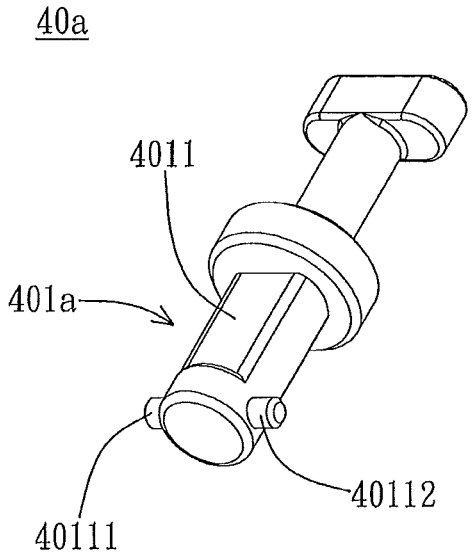
FIGS. 10A-10B are perspective and plan views of the rotatable fastener of the embodiment of FIGS. 7A-7B.
Figure 10B:
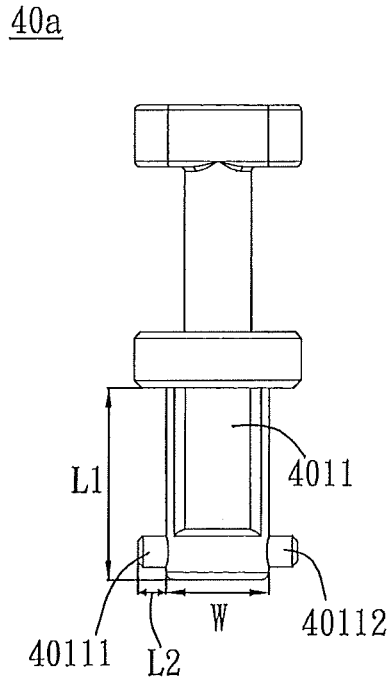
Figure 11A:
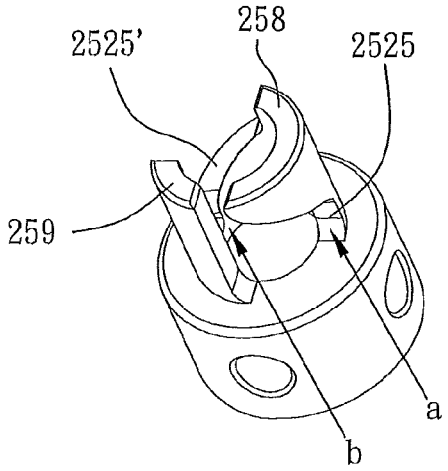
FIGS. 11A-11D are perspective and plan views of a driving portion of the embodiment of FIGS. 7A-7B.
Figure 11B:
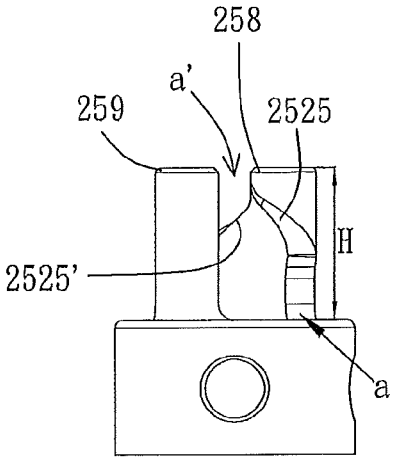
Figure 11C:
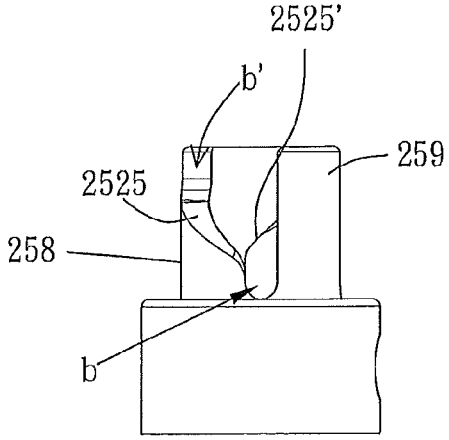
Figure 11D:
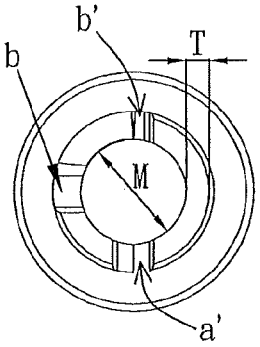

FIGS. 9A and 9B illustrate the lock body 20*a*, the joint unit 103*a*, and the rotatable fastener 40*a* without the inner housing 101*a*. The driving portion 252*a* is disposed on a platform 256*a*. The platform 256*a* is part of the lock core (not shown). When using the key 1 to unlock the lock body 20*a* and rotate the retaining portion 403*a* from a locked state (FIG. 9A) to an unlocked state (FIG. 9B), an elastic element (described later) will provide an elastic force to directly or indirectly release the restriction to the lock body device 20*a* so that the lock body 20*a*, along with the driving potion 252*a*, can move backward along the axial direction with respect to the inner housing 101*a* to be in an unlocked state. Conversely, pressing the lock body 20*a* will make the lock body 20*a*, along with the driving potion 252*a*, move inwardly along the axial direction with respect to the inner housing 101*a* to be in the locked state.

The rotatable fastener 40*a* is disposed at one side of the driving portion 252*a* opposite to the platform 256*a*. Similar to the above-mentioned embodiments of FIGS. 1-6D, the rotatable fastener 40*a* includes a base portion 401*a*, an extension portion 402*a*, a retaining portion 403*a*, and a shoulder portion 404*a* wherein the base portion 401*a* is disposed in the chamber of the housing 100*a* and coupled with the driving portion 252*a*. In operation, the action of pressing the lock body 20*a* makes the driving portion 252*a* move axially inward. However, the rotatable fastener 40*a* cannot move axially due to the shoulder portion 404*a* abutting an inside surface of the joint unit 103*a*. Therefore, moving the driving portion 252*a* axially inwardly drives the base portion 401*a* which causes the rotatable fastener 40*a* to rotate. The interactions between the lock body 20*a*, the driving portion 252*a*, and the rotatable fastener 40*a* will be described in detail later.

The relations among the rotatable fastener 40*a*, the joint unit 103*a*, and the lock hole of the electronic device is similar to the embodiments described above. That is, when the lock body 20*a* is axially advanced to be in the locked state, the retaining portion 403*a* of the rotatable fastener 40*a* protrudes outside a projection area of the protruding portion 1031*a* (i.e., the orientation of the retaining portion 403*a* is perpendicular to the virtual line $L_v$ connecting the two columnar structures) so that the rotatable fastener 40*a* can be engaged with the lock hole of the electronic device. When the lock body 20*a* is released by the key 1 and moves outwardly or backward in the axial direction to be in the unlocked state, the orientation of the retaining portion 403*a* is parallel to the protruding portion 1031*a* (i.e., the orientation of the retaining portion 403*a* is parallel to the virtual line $L_v$ connecting the two columnar structures) and the rotatable fastener 40*a* can be detached from or inserted into the lock hole of the electronic device.

Figure 12A:
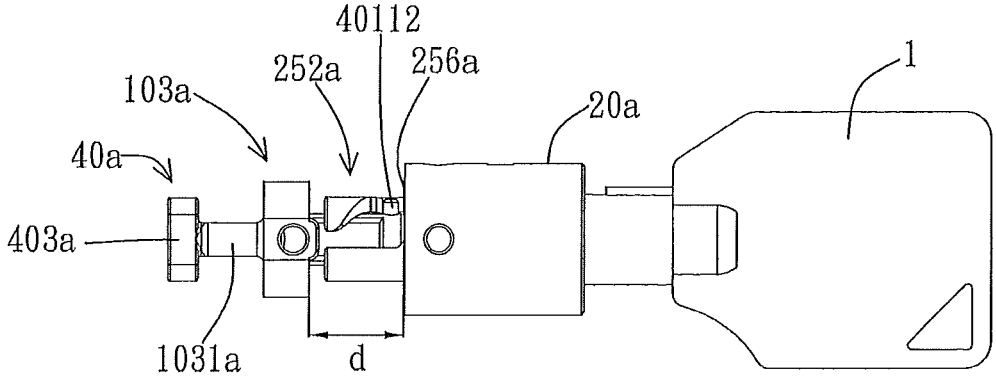
FIGS. 12A-12B are plan views of a driving portion coupled with a key of the embodiment of FIGS. 7A-7B.
Figure 12B:
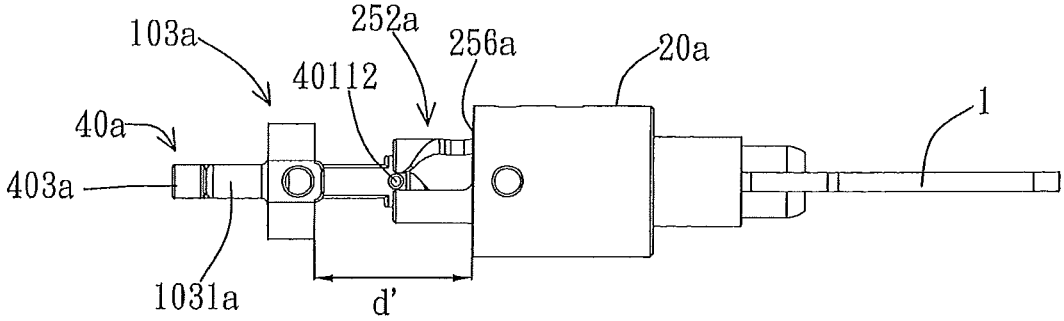

As FIGS. 9A-9B and FIGS. 10A-10B show, the base portion 401*a* has a body portion 4011. Two pins 40111 and 40112 are provided on one end of the body portion 4011 at opposite sides. The body portion 4011 has a width W, a length L1, and the pins 40111 and 40112 have a length L2. As FIGS. 9A-9B and FIGS. 11A-11D show, the driving portion 252*a* is formed with driving or cam surfaces 2525 and 2525'. The pins 40111 and 40112 are in contact with the driving or cam surfaces 2525 and 2525' when the rotatable fastener 40*a* is driven by the driving portion 252*a*. For example, when the driving portion 252*a* moves axially in either direction, because the rotatable fastener 40*a* cannot move axially, the pins 40111 and 40112 move along the driving or cam surfaces 2525 and 2525' so that the rotatable fastener 40*a* is caused to rotate. As FIGS. 9A-9B and FIGS. 11A-11D show, the driving or cam surfaces 2525 and 2525' can be formed by cutting a hollow cylinder, wherein the hollow cylinder has a height H, an inner diameter D, and a thickness T. The resulting driving portion 252*a* comprises two separate circumferential curved portions 258 and 259. Circumferential portion 258 includes two driving or cam surfaces 2525 and 2525' on opposite end surfaces, and the other circumferential portion 259 restricts movements of the pins 40111 and 40112. Positions a and b are end points of the driving or cam surfaces 2525 and 2525' adjacent the platform 256*a*. Positions a' and b' are the opposite end points of the driving or cam surfaces 2525 and 2525'. When the pins 40111 and 40112 are respectively located at the positions a and b (FIG. 9A), the base portion 401*a* of the rotatable fastener 40*a* is positioned inside the space defined by the circumferential portions 258 and 259. That is, the longitudinal length of the rotatable fastener 40*a* and the lock body 20*a* with the driving portion 252*a* is the shortest (FIG. 12A). When the pins 40111 and 40112 are respectively located at the positions a' and b', the longitudinal length of the rotatable fastener 40*a* and the lock body 20*a* with the driving portion 252*a* is the longest (FIG. 12B). By driving the pins 40111 and 40112 to move along the driving or cam surfaces 2525 and 2525', the positions of the pins 40111 and 40112 rotate ninety (90) degrees between position a and b and position a' and b' when the driving portion 252*a* moves axially toward (or away) the rotatable fastener 40*a*. This is a result of the shape of the driving surfaces 2525 and 2525'In the embodiment, the length L1 of the board body 4011 is preferably slightly greater than the height H of the cylinder, the width W of the body portion 4011 is slightly smaller than the inner diameter D, and the length L2 of the pin 40111 and 40112 is slightly greater than the thickness T. However, the mechanism by which the driving portion 252*a* drives the rotatable fastener 40*a* is not limited to the above embodiment; other mechanisms capable of producing the same effect can also be considered.

The joint unit 103*a* surrounds the rotatable fastener 40*a* which is disposed at one side of the driving portion 252*a*. Therefore, as FIGS. 12A-12B show, there is a distance between the joint unit 103*a* and the platform 256*a*. When the axial movement of the driving portion 252*a* toward the rotatable fastener 40*a* drives the pins 40111 and 40112 to be at the positions a and b (FIG. 12A), the rotatable fastener 40*a* and the driving portion 252*a* are closest and coupled with each other the most, wherein the distance between the joint unit 103*a* and the platform 256*a* is a distance d. When the axial movement of the driving portion 252*a* away from the rotatable fastener 40*a* drives the pins 40111 and 40112 to be at the positions a' and b' (FIG. 12B), the rotatable fastener 40*a* and the driving portion 252*a* are positioned the farthest apart, wherein the distance between the joint unit 103*a* and the platform 256*a* is increased to a distance d'. The distance d' is preferably the longest distance between the joint unit 103*a* and the platform 256*a*.

The change in distance between the joint unit 103*a* and the platform 256*a* also reflects the axial moving direction of the driving portion 252*a* relatively to the rotatable fastener 40*a*. The interactions among the axial movement of the driving portion 252*a*, the rotatable fastener 40*a*, and the lock body/operation device 20*a* will be elaborated later.

Figure 13A:
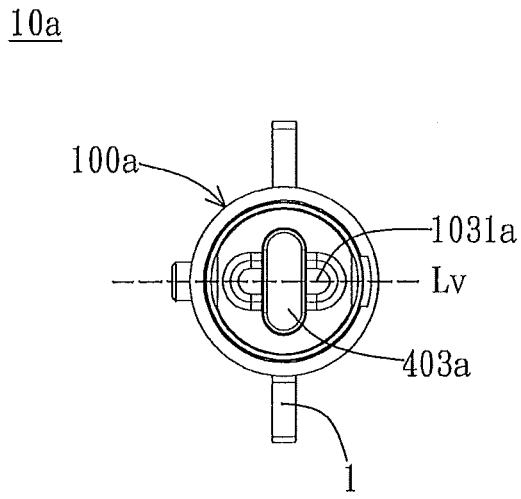
FIGS. 13A-13B are end views of the embodiments of FIGS. 12A-12B, respectively.
Figure 13B:
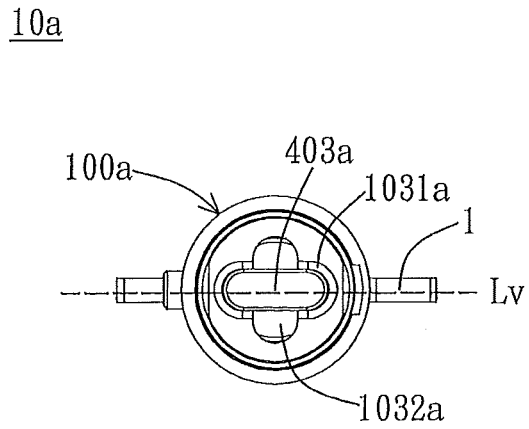

When using the key 1 to achieve the unlocking operation to enable the lock body 20*a* to be in the unlocked state, the restriction of the lock body 20*a* is released, namely the elastic element 270 disposed between the joint unit 103*a* and the platform 256*a* may provide an elastic force to the platform 256*a* so that the driving portion 252*a* moves axially, and the lock body 20*a* returns to the first or unlocked state, wherein the axial movement of the driving portion 252*a* is relatively away from the rotatable fastener 40*a* (i.e., outward) so that driving portion 252*a* can drive the pins 40111 and 40112 of the base portion 401*a* to move along the cam surfaces 2525 and 2525'. Therefore, when the axial movement of the driving portion 252*a* increases the distance between the joint unit 103*a* and the platform 256*a* from the distance d to the distance d' and changes the positions of the pins 40111 and 40112 from the positions a and b to the positions a' and b', the rotatable fastener 40*a* rotates ninety (90) degrees. At this time, it can be seen from the views shown in FIGS. 9B and 13B that the rotatable fastener 40*a* has rotated during the above-mentioned unlocking operation and the retaining portion 403*a* is parallel to the protruding portion 1031*a* (i.e., parallel to the virtual line $L_v$ connecting the two columnar structures). Similar to the above-mentioned embodiment, this structure enables the retaining portion 403*a* to be within the projection area of the protruding portion 1031*a* so that the connecting part (namely, the protruding portion 1031*a*, the extension portion 402*a* and the retaining portion 403*a*) can be inserted into or detached from the lock hole of the electronic device. Meanwhile, the elastic element 270 is released from compression and the lock body 20*a* is in the first or released/unlocked state, wherein the lock body 20*a* can be axially advanced to make the driving portion 252*a* move toward the rotatable fastener 40*a* in axial direction. The axial movement of the driving portion 252*a* drives the pins 40111 and 40112 of the base portion 401*a* to move along the cam surfaces 2525 and 2525'. Therefore, when the axial movement of the driving portion 252*a* decreases the distance between the joint unit 103*a* and the platform 256*a* from the distance d' to the distance d and changes positions of pins 40111 and 40112 from the position a' and b' to the positions a and b, the rotatable fastener 40*a* rotates ninety (90) degrees in a reverse direction. Namely, when the connecting part of the structure for connecting the lock hole of the electronic device is inserted into the lock hole, pressing the lock body 20*a* will make the retaining portion 403*a* rotate to the orientation as shown in FIGS. 9A and 13A, so as to engage with the lock hole of the electronic device. Meanwhile, the lock body 20*a* is now in the second or locked state which makes the lock structure 10*a* unable to be detached from the electronic device. Note that when the lock structure 10*a* is in the locked state, namely the lock body 20*a* is pressed, a retractable protrusion (not shown) rotates and extends into the slot 1022*b* rendering the lock body 20*a* immovable in the axial direction, so that the backward movement of the lock body 20*a* is restricted even when the pressing force is removed. When the lock structure 10*a* changes from the locked state to the unlocked state by use of an appropriately configured key 1, the retractable protrusion (not shown) rotates out of the slot 1022*b* and retracts into the inner housing 101*a*, so that the compressed elastic element 270 is released and provides the elastic force to allow the lock body 20*a* to move backward to be in the second or unlocked state. The protrusion 205 provided on the lock body 20*a* is confined within the slot 1022*a* and movable along the axial direction of the slot 1022*a* as the lock body 20*a* moves in the axial direction, so that axial movement of the lock body 20*a* is restricted.

Figure 14:
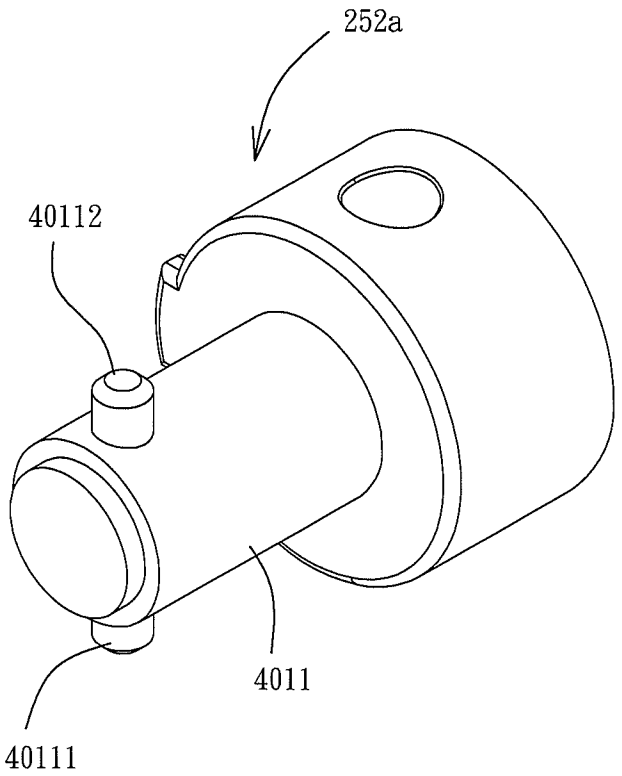
FIG. 14 is a perspective view of a driving portion of a second embodiment of the invention.
Figure 15A:
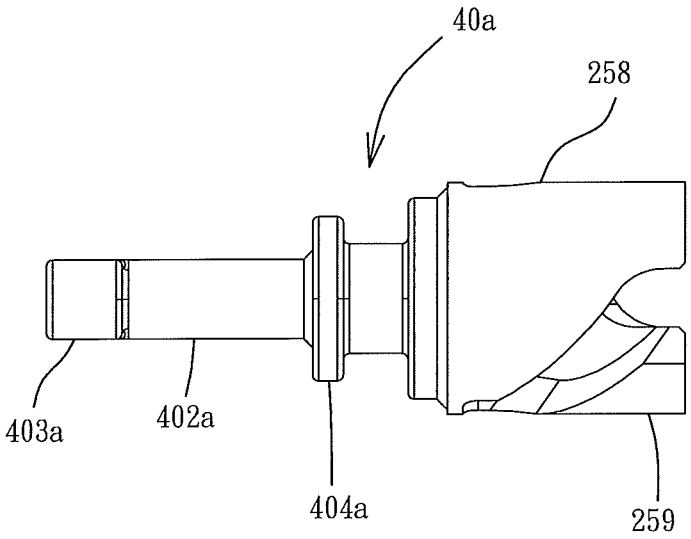
FIGS. 15A and 15B are plan and perspective views of the rotatable fastener of the second embodiment.
Figure 15B:
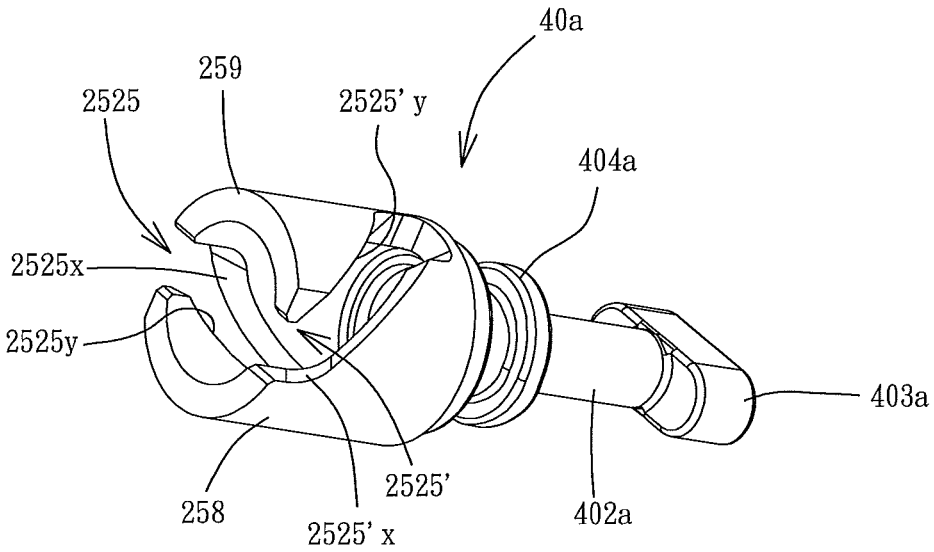

An alternative embodiment is shown in FIGS. 14-18. Compared to the embodiment of FIGS. 1-13, structure components of the driving portion 252*a* and rotatable fastener 40*a* have switched positions. More specifically, as shown in FIG. 14, the driving portion 252*a* comprises a shaft or columnar body 4011 with a pair of opposed pins 40111 and 40112 extending outwardly at the distal end of the columnar body 4011. As shown in FIGS. 15*a* and 15*b*, the cooperating end of the rotatable fastener 40*a* comprises a hollow cylinder comprising two separate circumferential curved portions 258 and 259. A pair of slots 2525 and 2525' are formed between the circumferential portions 258 and 259 and define cam surfaces 2525*x* and 2525*y* and 2525'*x* and 2525'*y*, respectively. The opposite end of the rotating member 40*a* comprises an extension portion 402*a* with a retaining portion 403*a* disposed on the distal end thereof with a shoulder portion 404*a* positioned between. When assembled, the pins 40111 and 40112 are positioned and move within slots 2525 and 2525'.

Figure 16A:
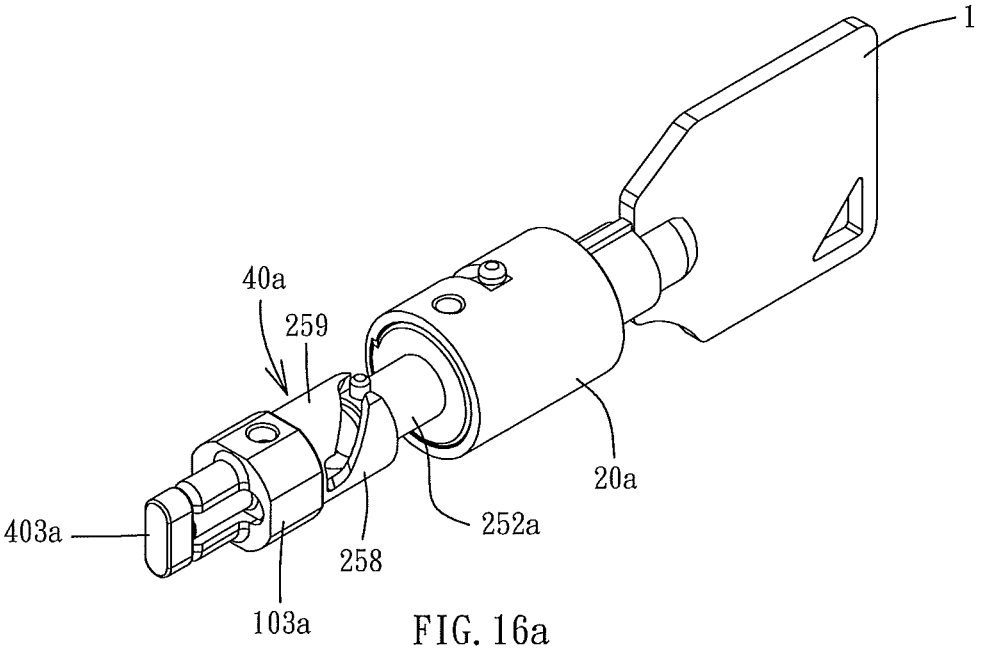
FIGS. 16A and 16B are perspective views of a portion of the lock of the second embodiment in unlocked and locked states, respectively.
Figure 16B:
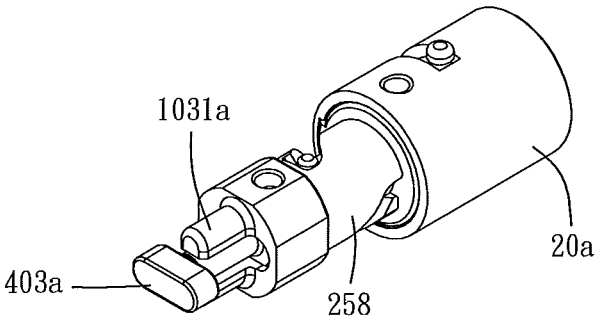

An assembled subassembly of the rotatable fastener 40*a*, joint unit 103*a*, driving portion 252*a*, lock body 20*a* and key 1, is shown in FIGS. 16*a* and 16*b*. FIG. 16*a* illustrates the components in an unlocked or first state. A key 1 is positioned within a keyway 204*a* formed in the lock structure 20*b* of the lock body 20*a* which extends axially outwardly from the lock body 20*a*. The lock structure 20*b* does not require a key to activate the lock. By pressing axially inwardly on the lock structure 20*b*, the driving portion 252*a*, including pins 40111 and 40112, is caused to move axially forward. As a result, the driven surfaces 2525 x and y and 2525' x and y of the receiving slots 2525 and 2525' interact with the axial movements of the pins 40111 and 40112 and, due to the curved or angled orientation, cause the rotatable fastener 40*a* to rotate, causing the retaining portion 403*a* to turn 90°. When the lock structure 20*b* is fully depressed, the lock body 20*a* achieves a locked position which cannot be released or unlocked without operation of an appropriately configured key 1. A locked or second state configuration is shown in FIG. 16*b*. Rotation of an appropriately configured key positioned in the key way will unlock the lock body 20*a*, releasing the driving portion. A lock core (not shown) inside the lock body 20*a* and the key hole 204 cooperate with an appropriately configured key to release the lock body 20*a*. The mechanism and operation with regard to the lock body 20*a* are similar to a conventional key lock and need not be elaborated as the structure and operation are known to those of skill in the art.

Figure 17A:
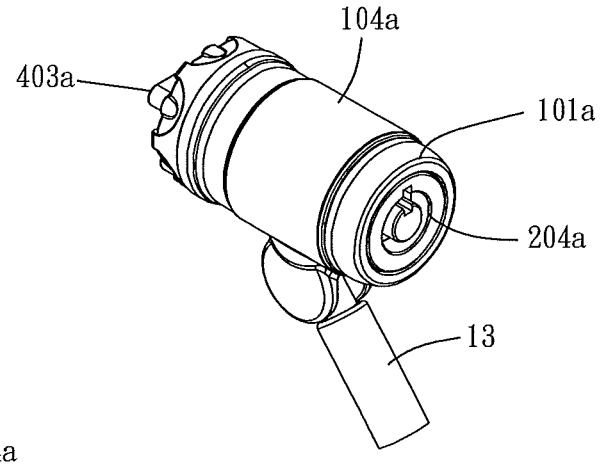
FIGS. 17A, 17B and 17C are perspective views of the lock of the second embodiment in a locked state (FIG. 17A) and an unlocked state (FIGS. 17B and 17C)
Figure 17B:
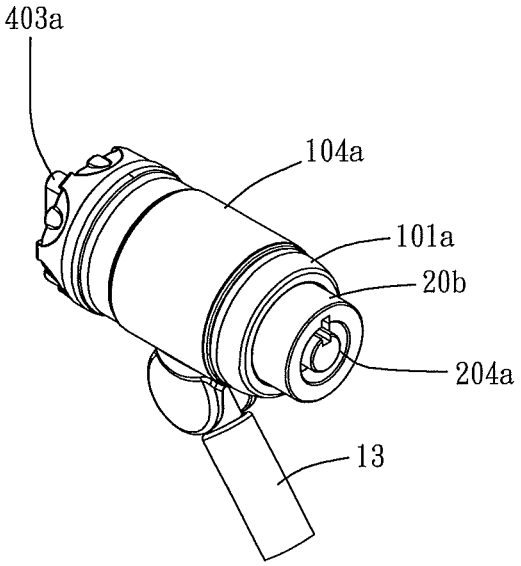
Figure 17C:
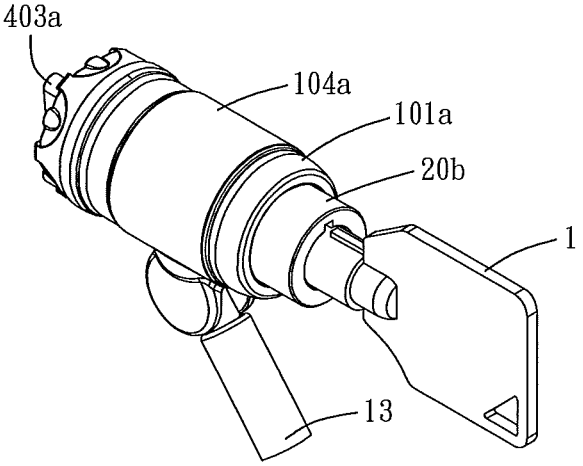
Figure 18:
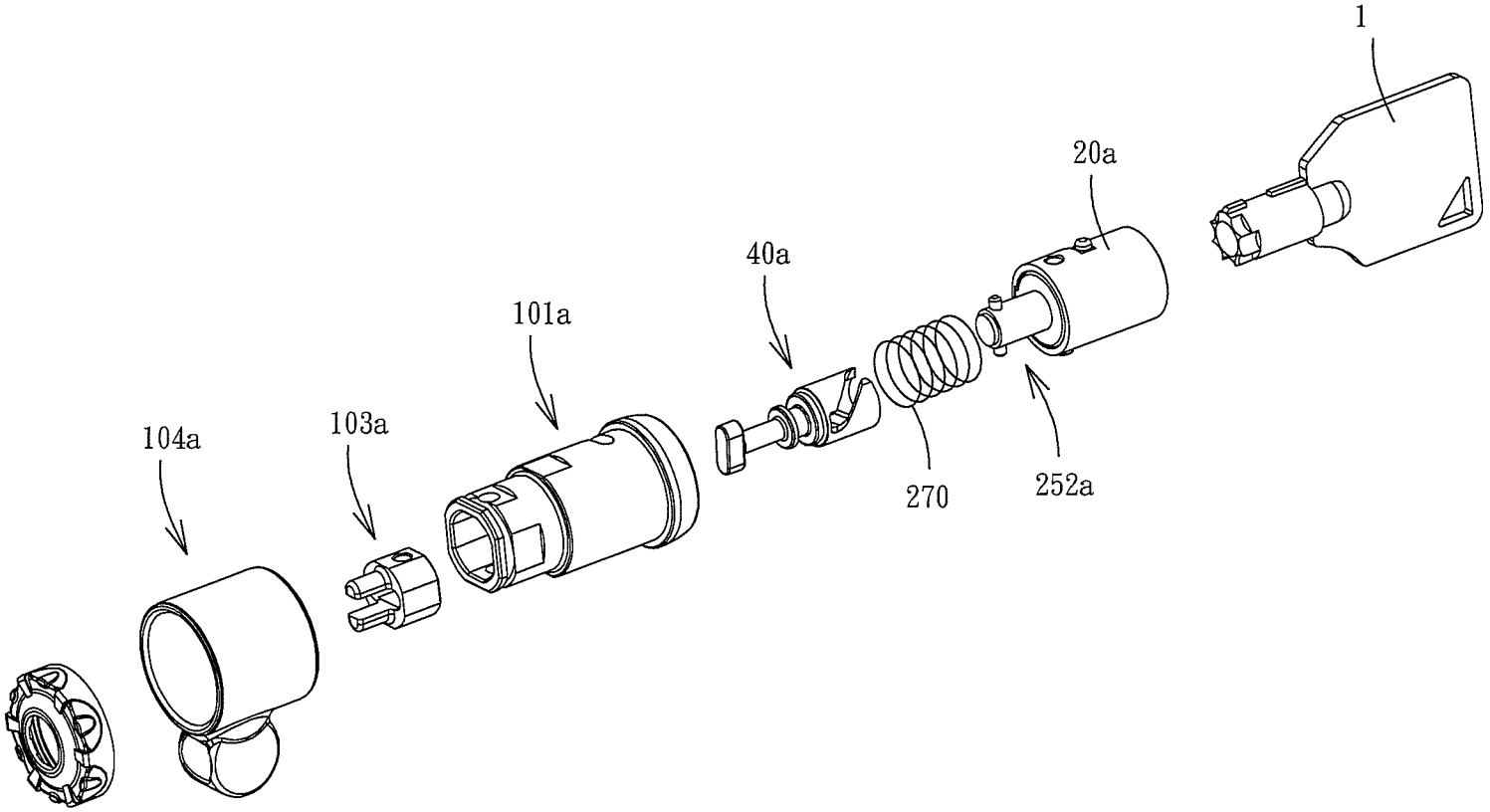
FIG. 18 is and exploded perspective view of the lock of the second embodiment.

Locked and unlocked orientations of the lock 10*a* of this embodiment are shown in FIGS. 17*a-c*, with FIG. 17*a* showing a locked configuration and FIGS. 17*b* and 17*c* showing an unlocked configuration, without and with a key. An exploded perspective view of components of this embodiment is shown in FIG. 18. A spring or other elastic member 270 will cause the driving portion 252*a* to move axially away from the retaining portion 403*a* when the key is rotated to an unlocked position. This causes the rotatable fastener 40*a* to move from a locked position to an unlocked position, thereby allowing the locking device 10*a* to be released from the security slot in which it had previously been positioned.

In other embodiments, the mechanisms by which the driving portion drives the rotatable fastener are not limited to the above mentioned cam surfaces and pins, any other mechanisms by which the operation device can drive directly or indirectly the rotatable fastener can be applied in the present invention.

Figure 19:
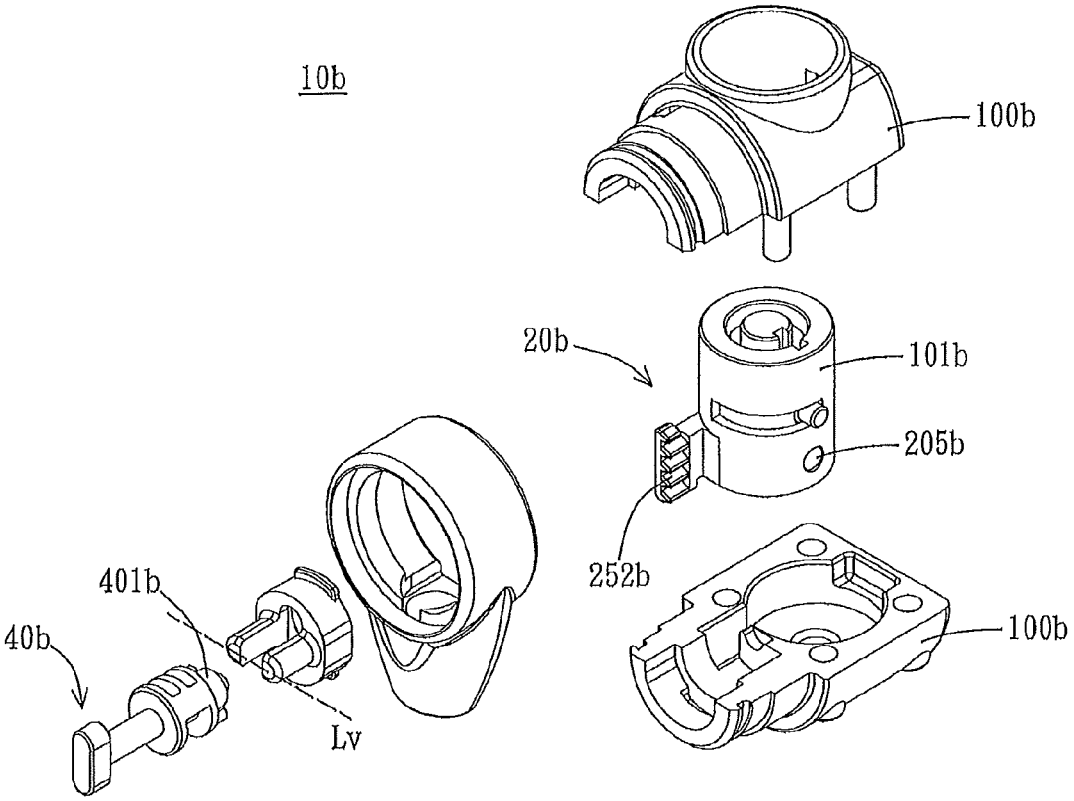
FIG. 19 is an exploded view of another embodiment of the present invention.
Figure 20A:
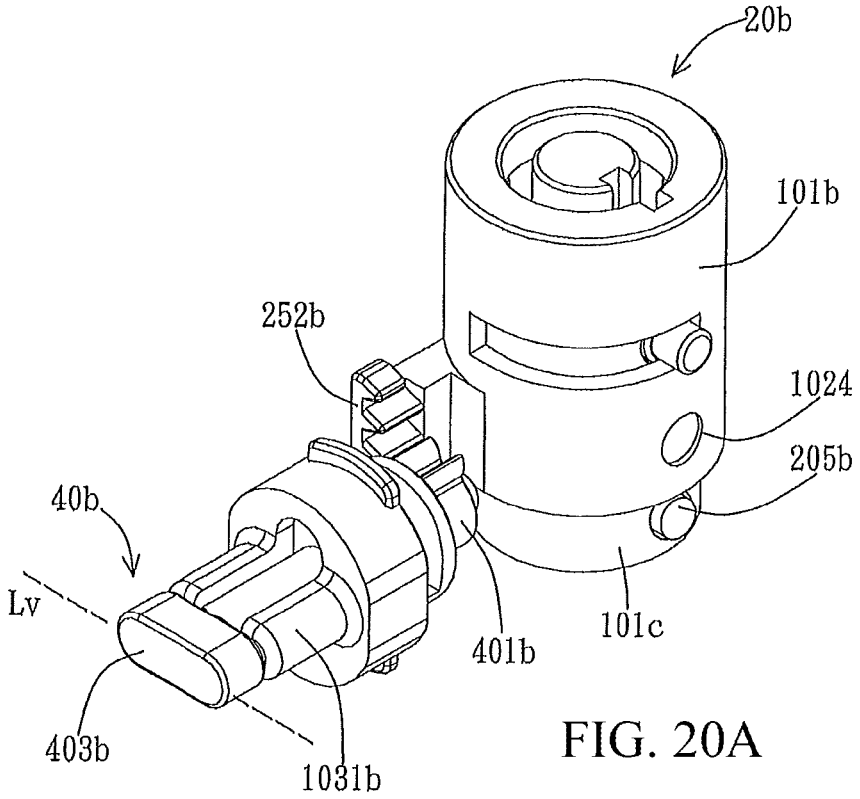
FIGS. 20A-20B are perspective views of a driving portion of the embodiment of FIG. 19.
Figure 20B:
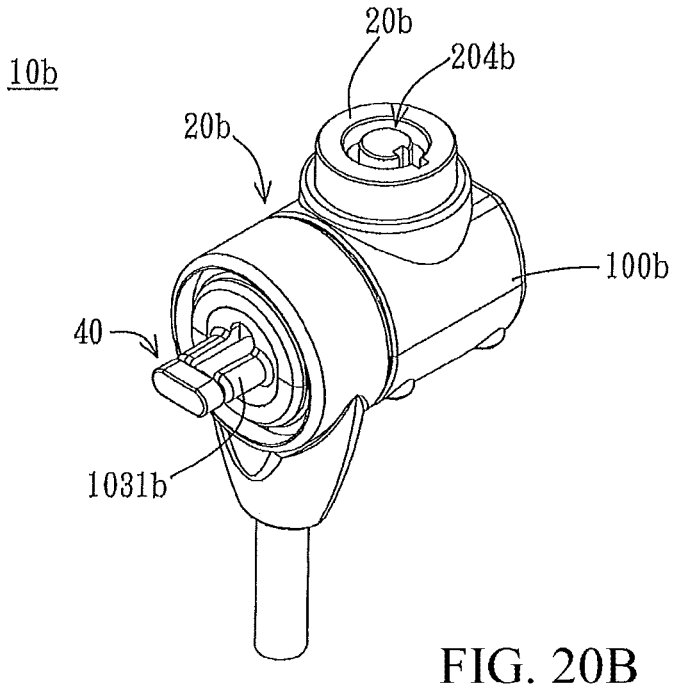
Figure 21B:
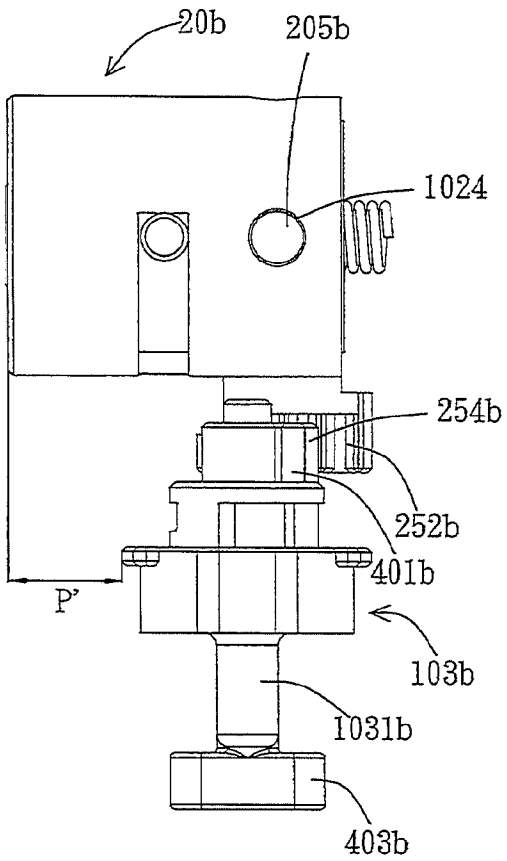
FIGS. 21A-21B are plan views of the embodiments of FIGS. 20A-20B.
Figure 21A:
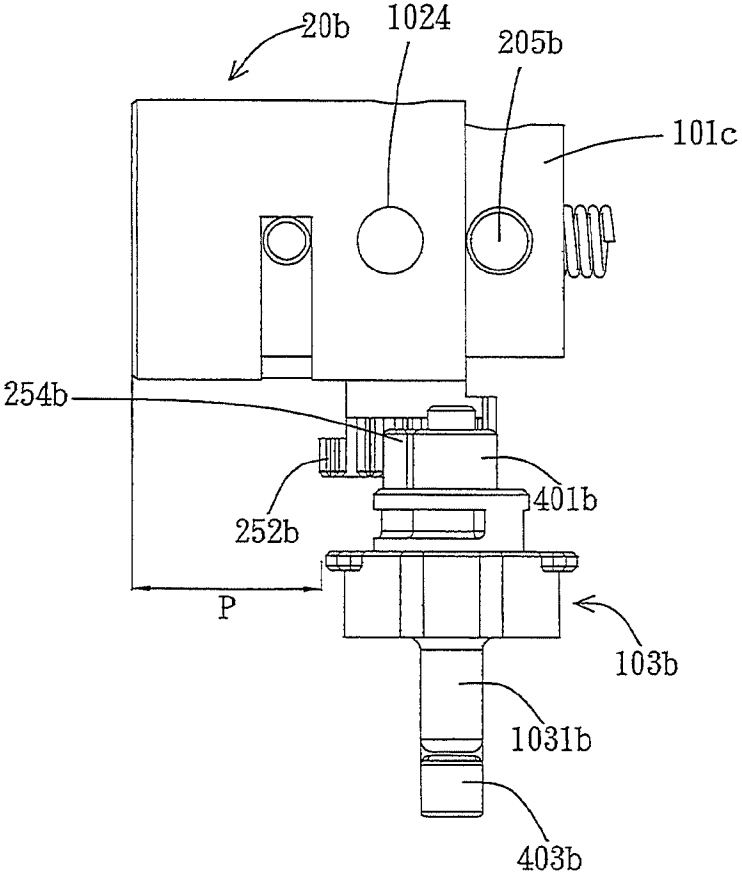
Figure 21C:
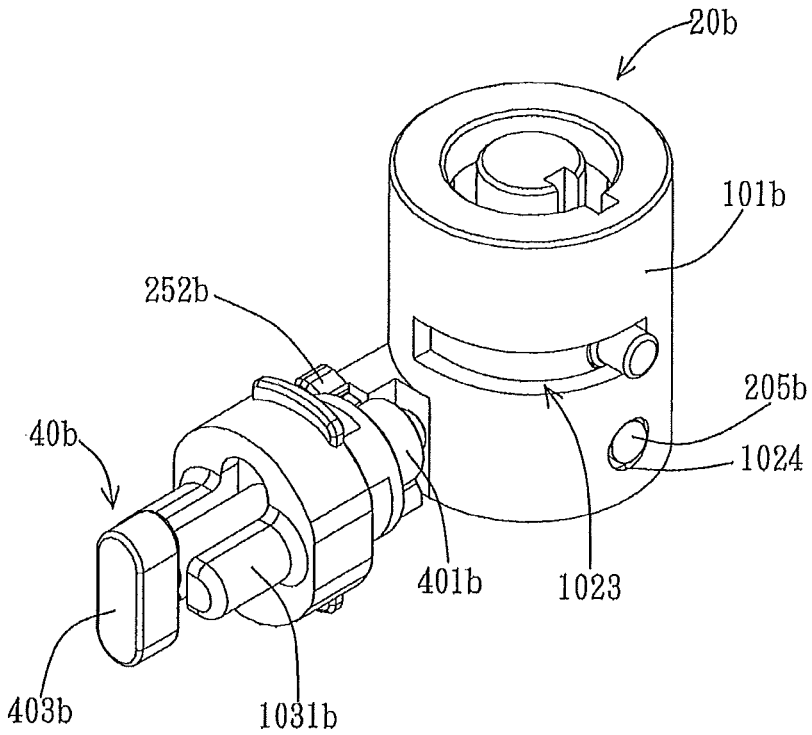
FIGS. 21C-21D are perspective views of a driving portion of the embodiment of FIG. 19, further showing the rotatable fastener in a locked position.
Figure 21D:
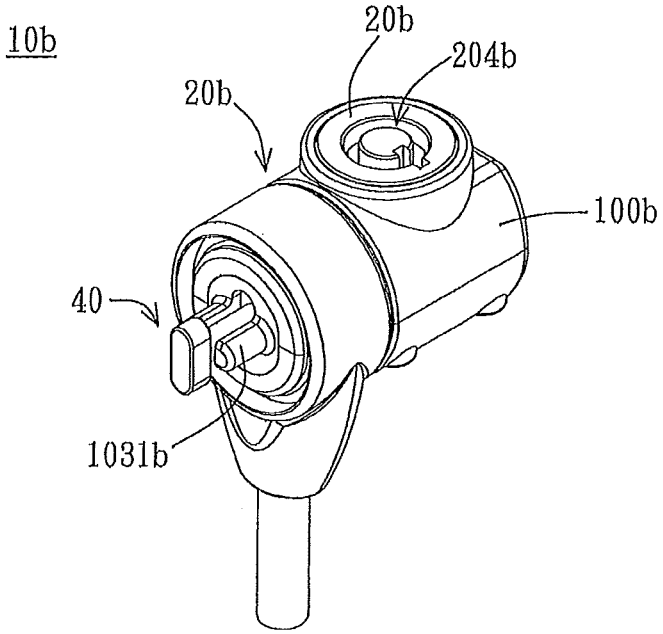

Another embodiment is shown in the exploded view of FIG. 19. The driving portion 252*b* is a gear rack, and the base portion 401*b* of the rotatable fastener 40*b* can be formed as a gear wheel 254*b* corresponding to the gear rack of the driving portion 252*b*; namely the teeth of the gear rack-like driving portion 252*b* of the lock body 20*b* is complementary to and couples with the gear teeth 254*b* of the base portion 401*b*. As FIG. 20A and 21A show, when the lock body 20*b* is in the first or unlocked state, the extension direction of the retaining portion 403*b* is parallel to the protruding portion 1031*b* (i.e., the virtual line $L_v$ connecting the two columnar structures), therefore the connecting part of the lock structure can be inserted into or detached from the lock hole. In addition, as shown in FIG. 20B, when the lock body 20*b* is in the first or unlocked state, an upper portion of the lock body 20*b* extends out of the housing 100*b*. Also in the unlocked state, a protrusion 205*b* extends from an inner portion 101*c* of the lock body. By pressing the lock body 20*b* from the unlocked position of FIG. 20B to the position of FIG. 21D, the locking operation illustrated in FIGS. 21A-21D is achieved. The lock body 20*b* moves relative to the stationary joint unit 103*b* (a distance between the lock body 20*b* and one end of the joint unit 103*b*decreases from a distance P' to a distance P), simultaneously the gear rack of the driving portion 252*b* rotates the gear 254*b* of the base portion 401*b* to make the rotatable fastener 40*b* rotate ninety (90) degrees. Pressing the lock body 20*b* also causes the inner housing 101*b*, which has the gear rack of the driving portion 252*b* disposed or formed thereon, to move toward the protrusion 205*b*. The protrusion 205*b* initially moves inwardly allowing the inner housing 101*b* to move relative to the inner portion 101*c*, and subsequently the protrusion 205*b* extends through aperture 1024 when the two structures are aligned. The position of the protrusion 205*b* in the aperture 1024 maintains the lock body 20*b* in the locked or pressed position shown in FIGS. 21B-21D.

On the other hand, when operating the lock body 20*b* to achieve the unlocked state, an appropriately configured key positioned and rotated in the key way of the lock body 20*b* causes the protrusion 205*b* to withdraw from the aperture 1024 which allows the lock body 20*b* to move relative to the joint unit 103*b* (the distance between the lock body/operation device 20*b* and one end of the joint unit 103*b* increases from the distance P' to the distance P), the gear rack of the driving portion 252*b* drives the gear 254*b* of the base portion 401*b*, so that the rotatable fastener 40*b* reversely rotates ninety (90) degrees. The configurations of the retaining portion 403*b* and the protruding portion 1031*b* in the locked/unlocked states are similar to the embodiments described above. As to the mechanisms and connections of the other components, please refer to the above-mentioned embodiment.

Figure 22:
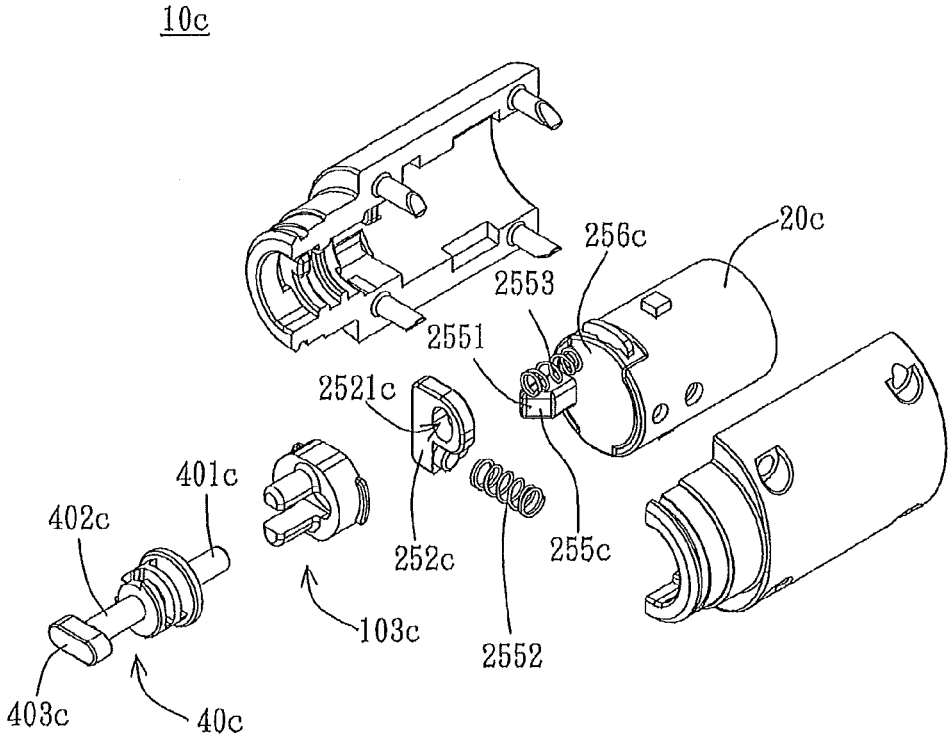
FIG. 22 is an exploded view of another embodiment of the present invention.
Figure 23A:
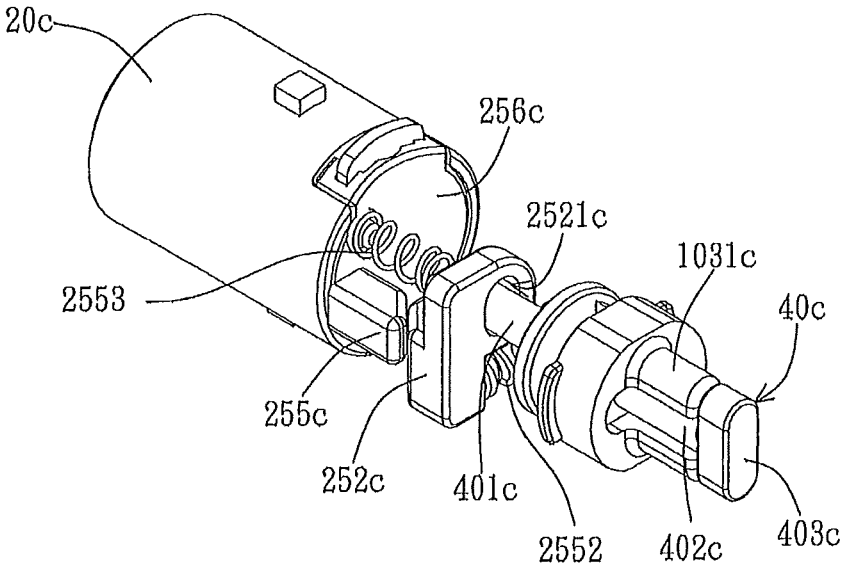
FIGS. 23A-23B are perspective views of the driving portion of the embodiment of FIG. 22.
Figure 23B:
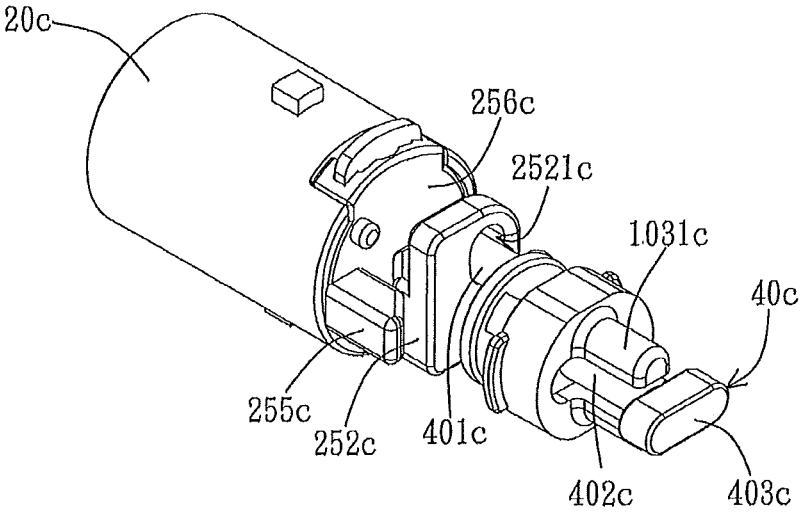
Figure 24A:
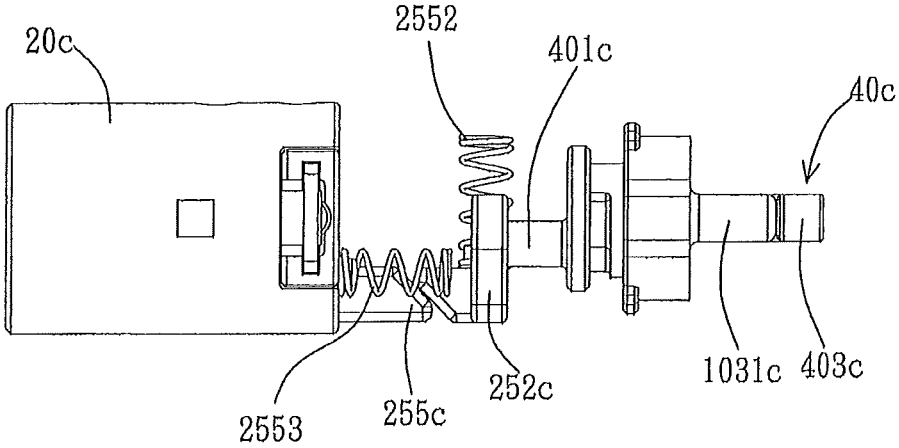
FIGS. 24A-24B are plan views of the driving portion of the embodiment of FIG. 22.
Figure 24B:
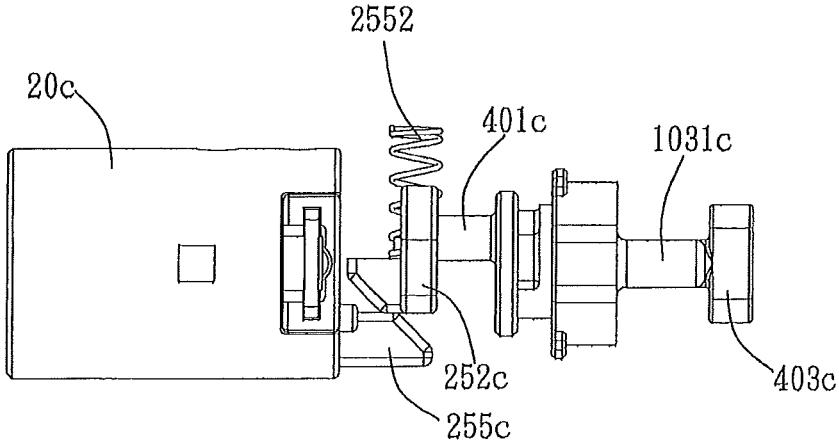

In another embodiment, as shown in FIG. 22, the driving portion 252*c* is separated from the lock body 20*c* but contiguous to a guiding block 255*c* formed on the platform 256*c*. The guiding block 255*c* can have an inclined face 2551 and may move together with the lock body 20*c* when the lock body 20*c* is pressed so that the driving portion 252*c* is pushed to move laterally or perpendicular to the axial movement of the lock body 20*a*. See, FIGS. 23A-23B. The driving portion 252*c* has an aperture or hole 2521*c* which receives the base portion 401*c* of the rotatable fastener 40*c*. The rod-like base portion 401*c* is not co-axially aligned with the extension portion 402*c*, but is axially offset to form an eccentric connection between the rotatable fastener 40*c* and the hole 2521*c* of the driving portion 252*c*. When the lock body 20*c* moves in the axial direction, the driving portion 252*c* moves along the inclined surface 2551 of the guiding block 255*c*. In turn, this causes the surrounding wall of the hole 2521*c* to interact with and push the base 401*c*. Because the base portion 401*c* is offset relative to extension portion 402*c*, the rotatable fastener 40*c* rotates to reposition the retaining portion 403*c* to achieve the locked/unlocked configuration. FIG. 24A shows the relative position of the guiding block 255*c* and the driving portion 252*c* when the lock body 20*c* is in the first or unlocked state. At this state, the orientation of the retaining portion 403*c* is parallel to the protruding portion 1031*c* (refer to FIG. 23A), therefore the connecting part can be inserted into or separated from the lock hole. When the lock body 20*c* is pressed to achieve the locking state as FIG. 24B shows, the lock body 20*c* moves axially toward the rotatable fastener 40*c* and the guiding block 255*c* pushes the driving portion 252*c* to move in a direction perpendicular to the movement direction of the guiding block 255*c* (i.e. along the inclined surface) so that the hole 2521*c* formed on the driving portion 252*c* interacts with the base portion 401*c* by the surrounding wall. Because the base portion 401*c* is offset, it moves along an arc route so that the rotatable fastener 40*c* can rotate ninety (90) degrees. As such, the retaining portion 403*c* and the protruding portion 1031*c* can engage with the lock hole. When the lock body 20*c* and the driving portion 252*c* move during pressing of the lock body 20*c*, the elastic elements 2552 and 2553 disposed at the relevant positions such as a position between the platform 256*c* and the driving portion 252*c* and a position between the driving portion 252*c* and an inner wall of the housing, will be compressed so as to provide elastic force for the lock body 20*c* to return to the first state, and for the driving portion 252*c* returning to the corresponding position when the lock body 20*c* is operated to achieve the unlocked state. As to the mechanism and connection of the other components, please refer to the above-mentioned embodiments in the present invention. Also, the type of lock shown is a key lock having disc tumblers that can extend and retract to secure the position of one or more components in a locked state.

In another embodiment shown in FIGS. 25A-27C, the operation device 25*d* is dependent upon the position of the lock body 20*d* of key lock. The unlocked/locked status of the lock body 20*d* controls the operation of the operation device 25*d* by restricting or releasing the movement of the operating device 25*d*.

Figure 25A:
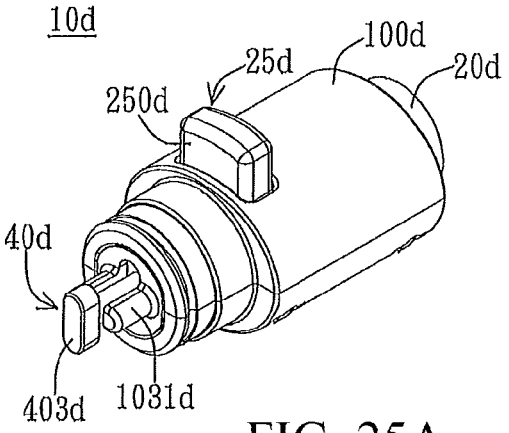
FIGS. 25A-25C are perspective and plan views of a driving portion of another embodiment of the present invention.

FIG. 25A shows that the operation device 25*d* is disposed partially outside the housing 100*d*. The lock body 20*d* is also disposed partially outside of the housing 100*d*. The connections of the components mentioned above are shown in FIGS. 25B-25C. In this embodiment, for example, the lock body 20*d* includes a restriction unit 203*d*, and the operation device 25*d* is disposed at one side of the restriction unit 203*d* opposite to the lock body 20*d*. Whether the operation device 25*d* can be operated is dependent on whether movement of the operation device 25*d* is restricted by the restriction unit 203*d*. The operating portion 25*d* further includes the driving portion 252*d* which directly causes the rotation of the rotatable fastener 40*d*, and a block unit 254*d* (described later). The components and interactions of the driving portion 252*d* and the base portion 401*d* for the rotatable fastener 40*d* are essentially the same as described herein in connection with the embodiment of FIGS. 19-24. As the driving portion 252*d* moves, the offset portion 401*d* moves through a curved path to rotate the retaining portion 403*d*.

Figure 25B:
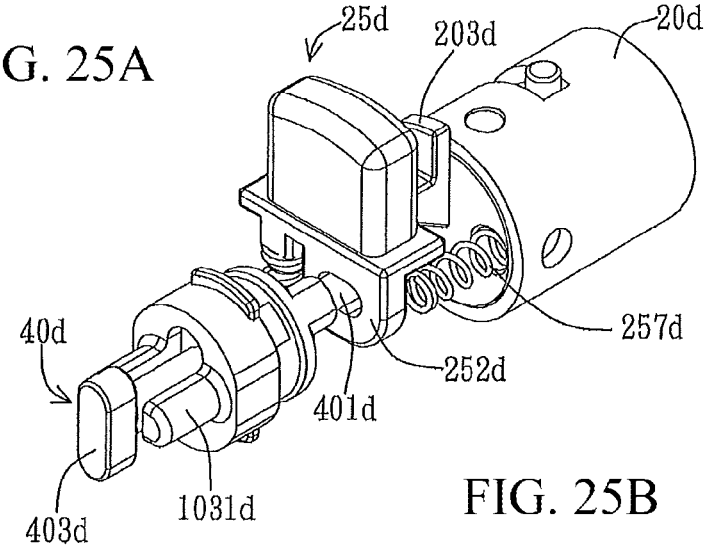
Figure 25C:
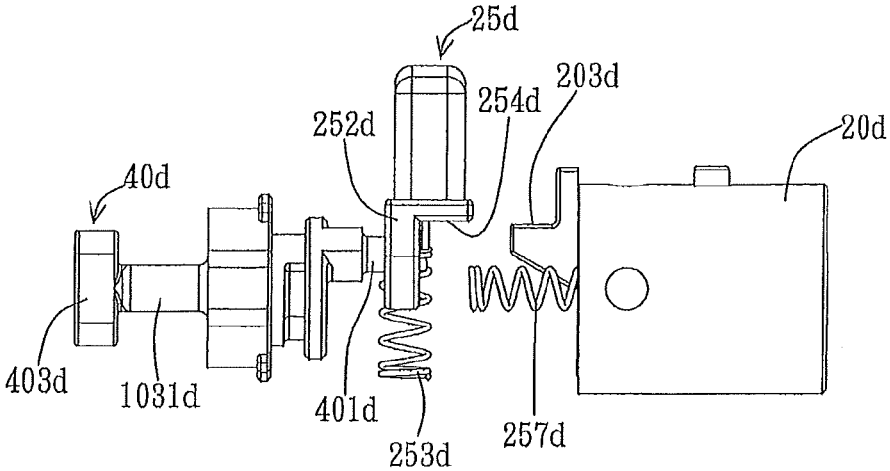

As FIGS. 25A-25C show, when the lock body 20*d* is in the unlocked state, the restriction unit 203*d* will be in a first position spaced from the block unit 254*d* so that movement of the operation device 25*d* is not restricted. That is, the operation of pressing the operation device 25*d* to move inwardly is possible. For example, the unpressed operation device 25*d*, shown in the FIG. 25A, is in the first state and is able to be operated or pressed. Meanwhile, the retaining portion 403*d* of the rotatable fastener 40*d* is oriented perpendicularly with respect to the protruding portion 1031*d*.

Figure 26A:
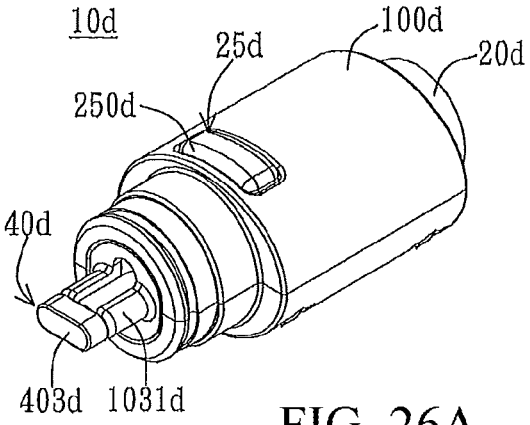
FIGS. 26A-26C are perspective and plan views of the driving portion of the embodiment of FIGS. 25A-25C.
Figure 26B:
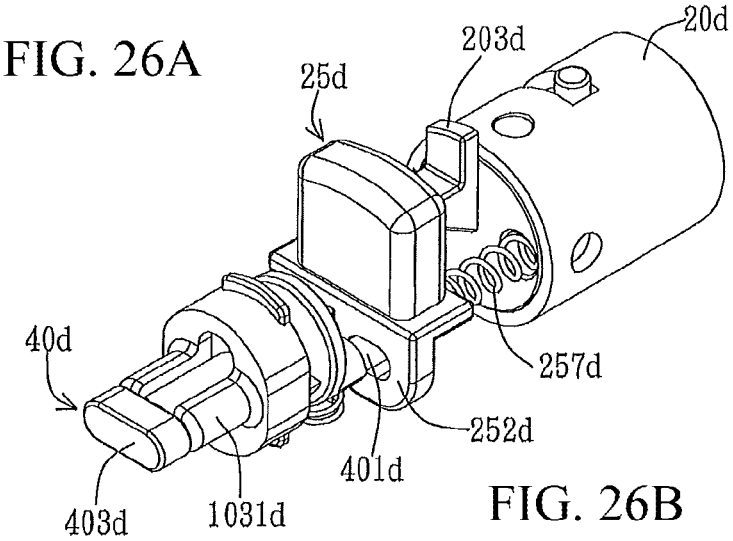
Figure 26C:
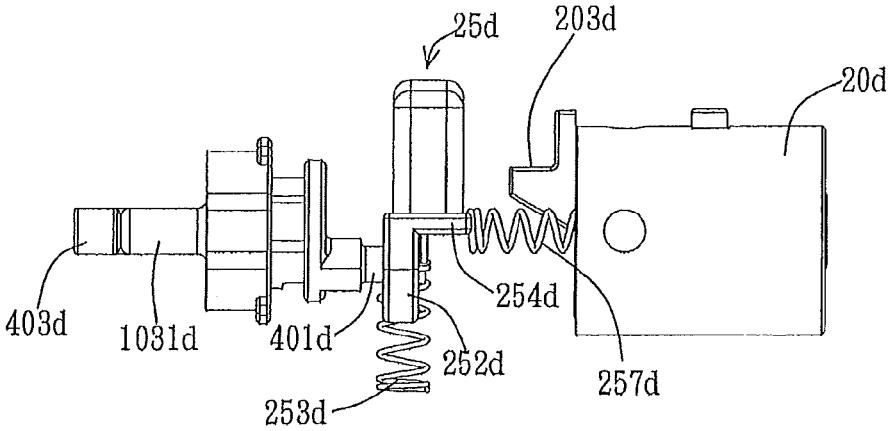

When pressing the operation device 25*d* of the lock structure 10*d* in the unlocked state, the operation device 25*d* will be displaced inwardly relative to the housing 100*d*. Therefore, the exposed length of the operating portion 25*d* outside the housing 100*d* is decreased. Meanwhile, the rotatable fastener 40*d* rotates ninety (90) degrees, so that the orientation of retaining portion 403*d* is parallel to the protruding portion 1031*d* (i.e., parallel to the virtual line $L_v$ connecting the two columnar structures). As a result, pressing the operation device 25*d* enables the connecting part of lock structure 10*d* to be inserted into or detached from the lock hole. The relations among the components in the interior of the lock are shown in FIGS. 26B-26C. The displacement of the operation device 25*d* toward the housing 100*d* changes the position of the operation device 25*d* relative to the restriction unit 203*d*. The change in relative position can be seen from a comparison of FIGS. 25C and 26C, wherein the position of the block unit 254*d* changes from a relative position above to a position below the restriction unit 203*d*. The displacement of the operation device 25*d* enables the driving portion 252*d* to drive the base portion 401*d* to cause the rotation of the rotatable fastener 40*d* and compresses the elastic element 253*d* disposed at a relevant position, such as a position between the operation device 25*d* and an inner wall of the housing 100*d*. When compressed, the elastic element 253*d* provides elastic force to make the operation device 25*d* displace in a reverse direction (namely outwardly and away from the housing) to its original position as shown in FIGS. 25A-25C. Meanwhile, the displacement of the operation device 25*d*, including the driving portion 252*d*, away from the housing 100*d* drives the base portion 401*d* in the reverse direction so that the rotatable fastener 40*d* rotates ninety (90) degrees to orient the retaining portion 403*d* parallel to the protruding portion 1031*d*.

Figure 27A:
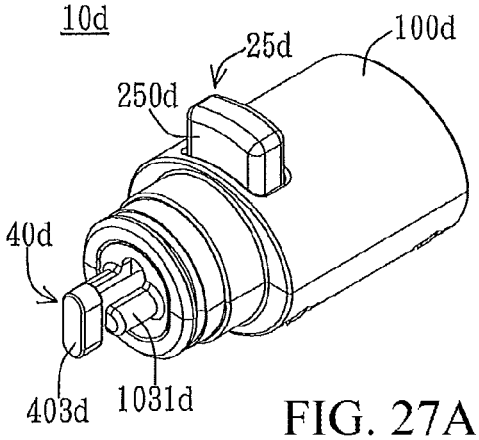
FIGS. 27A-27C are perspective and plan views of the driving portion of the embodiment of FIGS. 25A-25C.
Figure 27B:
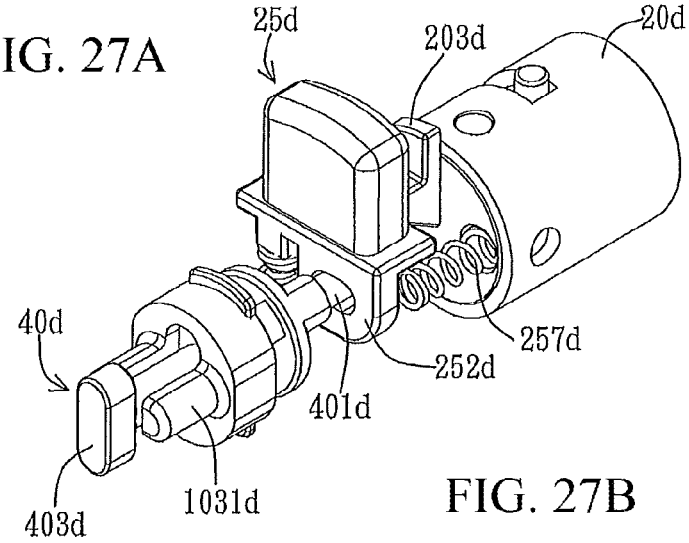
Figure 27C:
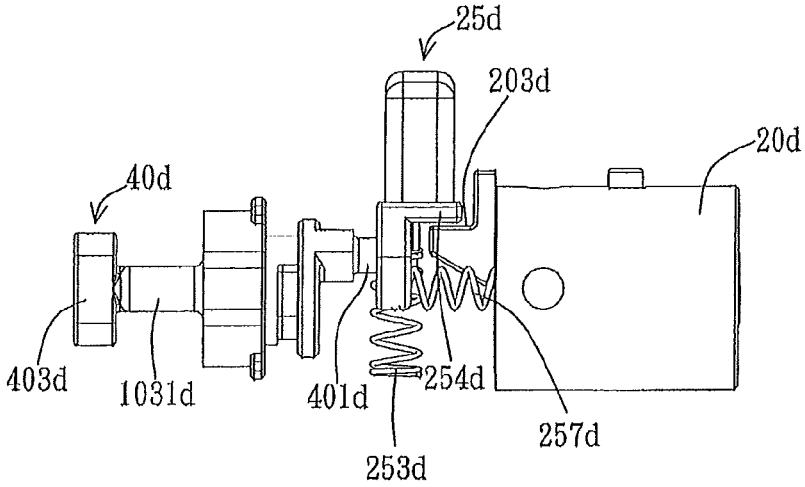

However, when the operation device 25*d* is not pressed, as FIGS. 25B-25C show, a user is able to operate the lock body 20*d* to achieve the locking operation, as FIGS. 27A-27C show. In this embodiment, locking the lock body 20*d* is achieved by pressing the lock body 20*d* in the axial direction toward the rotatable fastener 40*d*. In this way, the restriction unit 203*d* of the lock body 20*d* will meet and block or prevent movement of the block unit 254*d* as the restriction unit 203*d* will be positioned in the displacement path of the operation device 25*d*, so that the driving portion 252*d* cannot be pressed to drive the rotatable fastener 40*d* to rotate. In this position the lock body 20*d* is locked or secured in its position by rotation of a key. The components that enable such locking of the position of the lock body 20*d* are known to those of skill in the art and need not be described here. Thus, when the lock body 20*d* is in the locked state, the operation device 25*d* is prohibited and the rotatable fastener 40*d* cannot rotate ninety (90) degrees.

Although the preferred embodiments of present invention have been described herein, the above description is merely illustrative. The preferred embodiments disclosed will not limited the scope of the present invention. Further modification of the invention herein disclosed will occur to those skilled in the respective arts and all such modifications are deemed to be within the scope of the invention as defined by the appended claims.

The present invention, in various embodiments, includes components, methods, processes, systems and/or apparatus substantially as depicted and described herein, including various embodiments, sub combinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. The features of the embodiments of the invention may be combined in alternate embodiments other than those discussed above. This method of disclosure is not to be interpreted as reflecting an intention that the claimed invention requires more features than are expressly recited in each claim. Rather, as the following claims reflect, inventive aspects lie in less than all features of foregoing disclosed embodiments. Thus, the following claims are hereby incorporated into this Detailed Description, with each claim standing on its own as a separate preferred embodiment of the invention.

Moreover, though the description of the invention has included description of one or more embodiments and certain variations and modifications, other variations, combinations, and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A lock structure for lockably attaching and detaching to a lock hole associated with an object to be secured, comprising:

a rotatable fastener for connecting to the lock hole, the rotatable fastener having an extension portion and a retaining portion disposed at the distal end of the extension portion, the extension portion defining an axis along its length and about which the rotatable fastener rotates, the retaining portion having a length and a width, the length being greater than width and the length being oriented perpendicular to the axis;

a driving portion axially aligned with and interconnected to the rotatable fastener at the opposite end of the rotatable fastener from the retaining portion, the driving portion linearly movable between a first position and a second position; and, a lock body coupled to the driving portion, the lock body having a locked state and an unlocked state;

wherein when the lock body moves from an unlocked state to a locked state, the linear movement of the driving portion causes the rotatable fastener to rotate about the axis which causes the retaining portion to rotate from an unlocked position to a locked position.

2. The lock structure of claim 1, wherein the lock body is a key lock having a key hole and the lock body moves along the axis defined by the extension portion in a locking and an unlocking operation.

3. The lock structure of claim 2, wherein the rotatable fastener comprises a driven portion that is positioned concentrically outside the driving portion.

4. The lock structure of claim 1, wherein the rotatable fastener comprises a driven portion that is positioned concentrically inside the driving portion.

5. The lock structure of claim 4, wherein the driving portion comprises a first driving surface and a second driving surface, and the rotatable fastener comprises a first follower and a second follower, such that when the lock body moves between a locked state and an unlocked state, the first surface engages the first follower to rotate the rotatable fastener in a first direction and when the lock body moves from an unlocked state to a locked state, the second driving surface engages the second follower to rotate the rotatable fastener in a second direction.

6. The lock structure of claim 1, wherein the driving portion comprises a first pin and a second pin, and the rotatable fastener comprises a first driven surface and a second driven surface, and wherein when the lock body moves between a locked state and an unlocked state, the first pin moves axially and causes the rotatable fastener to rotate in a first direction and when the lock body moves from an unlocked state to a locked state, the second pin moves axially and caused the rotatable fastener to rotate in the opposite direction.

7. A lock comprising:

a housing;

a lock body disposed within the housing and linearly movable within the housing between a first position and a second position;

a rotatable fastener having a first and a second end, the second end comprising an extension portion and a retaining portion transversely mounted to the extension portion, the extension portion defining an axis along its length and about which the rotatable fastener rotates;

connecting means disposed between the first end of the rotatable fastener and the lock body for interconnecting the lock body to the rotatable fastener;

wherein, when the lock body moves between the first position and the second position, the connecting means moves linearly and causes the rotatable fastener and the retaining portion to rotate.

8. The lock of claim 7, wherein the connecting means comprises at least one pin and the first end of the rotatable fastener comprises a driven surface that engages the at least one pin.

9. The lock of claim 7, wherein the connecting means comprises at least one surface and the first end of the rotatable fastener comprises a pin that engages the at least one surface.

10. A lock assembly, comprising:

a housing;

a lock body disposed within the housing and linearly movable within the housing;

a locking mechanism disposed within the lock body, the locking mechanism comprising a keyway for receiving a key;

a driving portion operatively associated with the lock body and linearly movable between a first position and a second position upon linear movement of the lock body;

a rotatable fastener having a first end and a second end, and a retaining member disposed at the second end;

the driving portion concentrically coupled to the first end of the rotatable fastener;

wherein, when the driving portion moves from the first position to the second position, the rotatable fastener moves from an unlocked position to a locked position and when the driving portion moves from the second position to the first position, the rotatable fastener moves from a locked position to an unlocked position.

11. The lock assembly of claim 10, wherein at least part of the driving portion is positioned concentrically inside the first end of the rotatable fastener.

12. The lock assembly of claim 10, wherein at least part of the driving portion is positioned concentrically outside of the first end of the rotatable fastener.

13. The lock assembly of claim 12, wherein the driving portion comprises a driving surface and the first end of the rotatable fastener comprises a pin, and wherein linear movement of the driving portion causes engagement of the driving surface and the pin and rotational movement of the rotatable fastener.

14. The lock assembly of claim 10, further comprising elastic means for storing energy upon movement of the locking mechanism from a first unlocked position to a second locked position, whereby when the locking mechanism is unlocked, the elastic means drives the driving portion from the locked position to the unlocked position and rotates the retaining member to an unlocked position.

15. The lock assembly of claim 11, wherein the driving portion comprises a pin and the first end of the rotatable fastener comprises a driven surface, and wherein linear movement of the driving portion causes engagement of the pin and the driven surface and rotational movement of the rotatable fastener.

* * * * *